US010297436B2

(12) United States Patent
Tsybin et al.

(10) Patent No.: US 10,297,436 B2
(45) Date of Patent: May 21, 2019

(54) DEVICE AND METHOD FOR ION CYCLOTRON RESONANCE MASS SPECTROMETRY

(71) Applicant: ECOLE POLYTECHNIQUE FEDERALE DE LAUSANNE (EPFL), Lausanne (CH)

(72) Inventors: Yury Tsybin, Saint-Sulpice (CH); Anton Kozhinov, Lausanne (CH); Konstantin Nagornov, Préverenges (CH)

(73) Assignee: ECOLE POLYTECHNIQUE FEDERALE DE LAUSANNE (EPFL), Lausanne (CH)

( * ) Notice: Subject to any disclaimer, the term of this patent is extended or adjusted under 35 U.S.C. 154(b) by 0 days.

(21) Appl. No.: 15/303,226

(22) PCT Filed: Apr. 14, 2015

(86) PCT No.: PCT/IB2015/052708
§ 371 (c)(1),
(2) Date: Oct. 11, 2016

(87) PCT Pub. No.: WO2015/162521
PCT Pub. Date: Oct. 29, 2015

(65) Prior Publication Data

US 2017/0032950 A1 Feb. 2, 2017

(30) Foreign Application Priority Data

Apr. 14, 2014 (WO) ..... PCT/IB2014/060709

(51) Int. Cl.

| | |
|---|---|
| ***H01J 49/38*** | (2006.01) |
| ***H01J 49/02*** | (2006.01) |
| ***H01J 49/00*** | (2006.01) |

(52) U.S. Cl.
CPC ..... *H01J 49/38* (2013.01); *H01J 49/0031* (2013.01); *H01J 49/027* (2013.01)

(58) Field of Classification Search
None
See application file for complete search history.

(56) References Cited

U.S. PATENT DOCUMENTS

2006/0226357 A1* 10/2006 Franzen ..... H01J 49/38 250/307

FOREIGN PATENT DOCUMENTS

DE 10 2009 050039 A1 4/2011
DE 10 2010 044878 A1 3/2012

OTHER PUBLICATIONS

Boldin, I. A., & Nikolaev, E. N. (2011). Fourier transform ion cyclotron resonance cell with dynamic harmonization ofthe electric field in the whole volume by shaping of the excitation and detection electrode assembly. Rapid Communications in Mass Spectrometry, 25(1), 122-126.

(Continued)

*Primary Examiner* — James Choi
(74) *Attorney, Agent, or Firm* — Andre Roland S.A.; Nikolaus Schibli

(57) ABSTRACT

The present invention relates to a method and device for measuring m/z ratios of ions in ion cyclotron resonance (ICR) mass spectrometry. The described ion traps for ICR mass spectrometry are distinct from the previous configurations by having one or many narrow aperture (flat) detection electrodes that could be moved radially inward the ICR trap, for example on the plane where radiofrequency excitation potential is minimal, closer to the post-excitation ion trajectories.

30 Claims, 25 Drawing Sheets

(56) References Cited

OTHER PUBLICATIONS

Guan, S., & Marshall, A. G. (1995). Ion traps for Fourier transform ion cyclotron resonance mass spectrometry: principles and design of geometric and electric configurations. International Journal of Mass Spectrometry and Ion Processes, 146, 261-296.
Hendrickson, C. L., Drader, J. J., & Laude, D. A. (1995). Simplified application of quadrupolar excitation in Fourier transform ion cyclotron resonance mass spectrometry. Journal of the American Society for Mass Spectrometry, 6(5), 448-452.
Nikolaev, E. N., Gorshkov, M. V., Mordehai, A. V., & Talrose, V. L. (1990). Ion cyclotron resonance signal•detection at multiples of the cyclotron frequency. Rapid Communications in Mass Spectrometry, 4(5), 144-146.
Nikolaev, E. N., Vladimirov, G. N., Jertz, R., & Baykut, G. (2013). From supercomputer modeling to highest mass resolution in FT-ICR. Mass Spectrometry, 2(Spec Iss).
International Search Report of PCT/IB2015/052708 dated Aug. 6, 2015.
Marshall, A. G.; Hendrickson, C. L. : "High-resolution mass spectrometers." In Annual Review of Analytical Chemistry 2008, 7, 579-599.
Marshall, A.G.; Hendrickson, C.L.; Jackson, G.S. "Fourier Transform Ion Cyclotron Resonance Mass Spectrometry: A Primer" Mass Spectrom. Rev. 1998, 77, 1-35.
Scigelova, M.; Hornshaw, M.; Giannakopulos, A.; Makarov, A.: "Fourier transform mass spectrometry." Molecular & Cellular Proteomics 2011, 10, M111.009431.
Written Opinion of the International Search Authority dated Aug. 6, 2015.
Xian, F.; Hendrickson, C. L.; Marshall, A. G : "High resolution mass spectrometry." Analytical Chemistry 2012, 84, 708-719.
Zubarev, R. A.; Makarov, A. "Orbitrap mass spectrometry." Analytical Chemistry 2013, 85, 5288-5296.

* cited by examiner

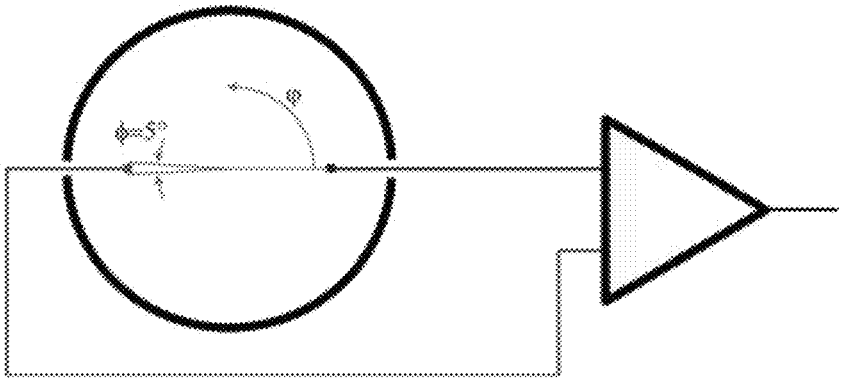
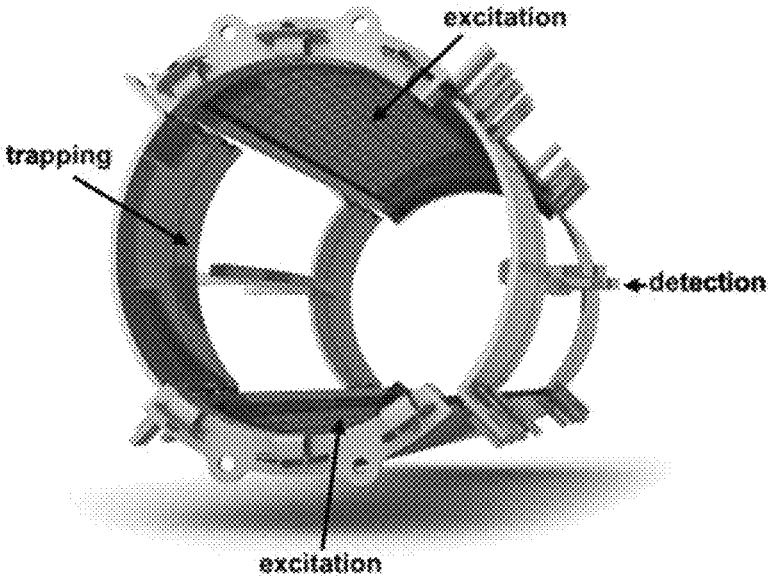
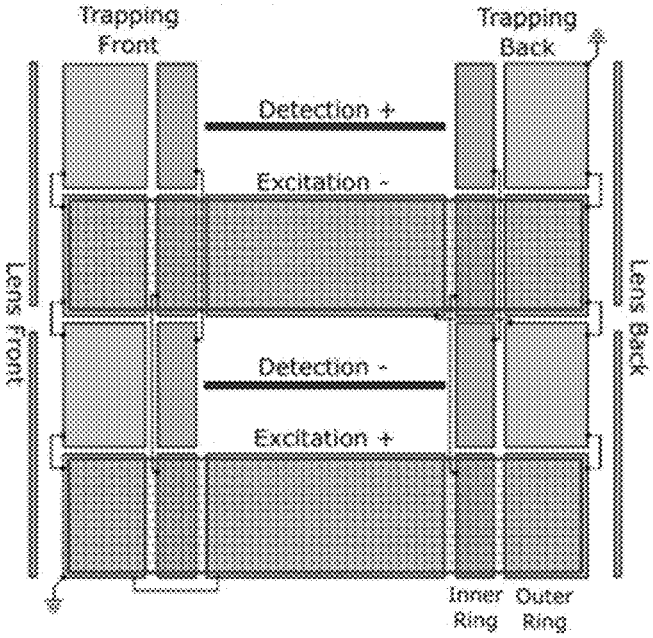
Fig.2

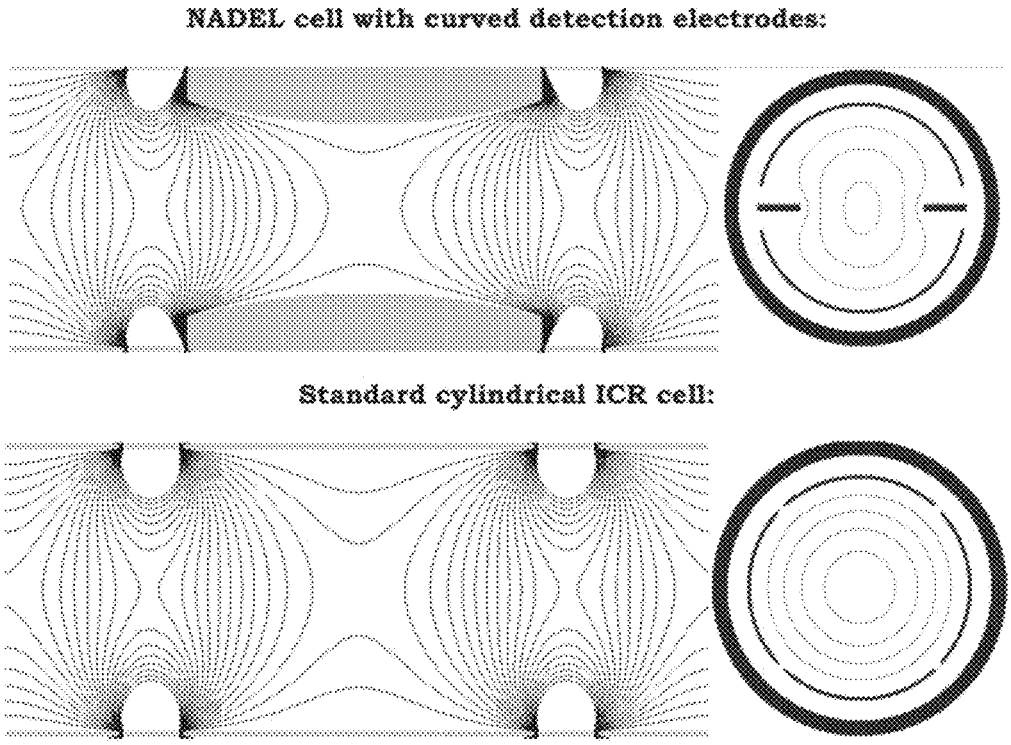
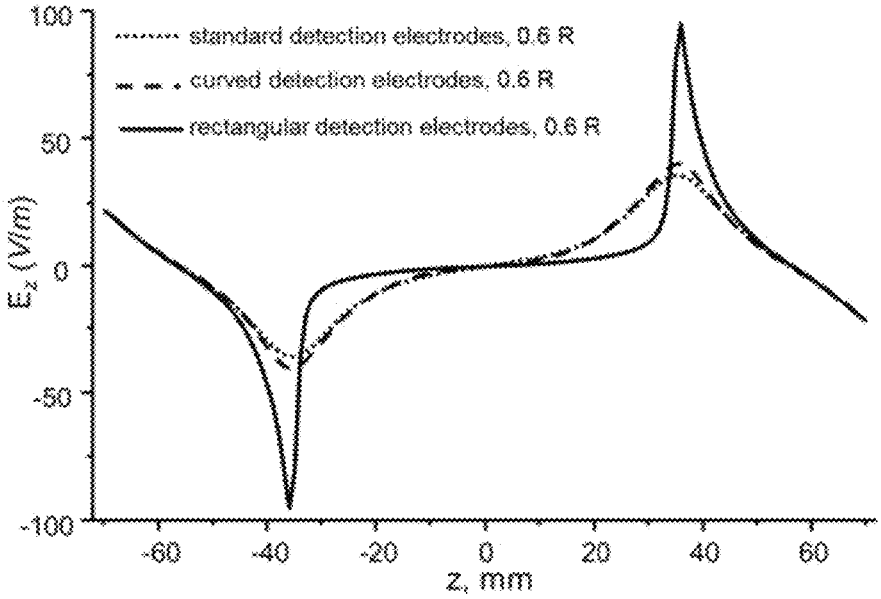
Fig.4

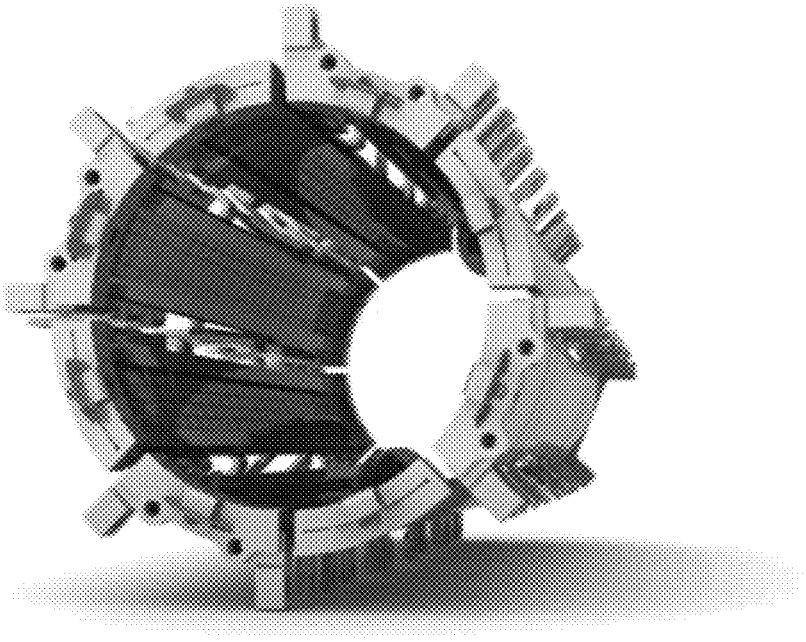
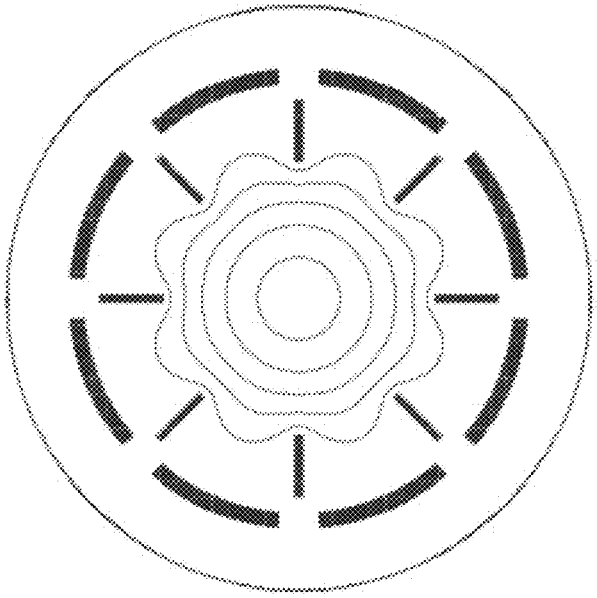
Fig.7

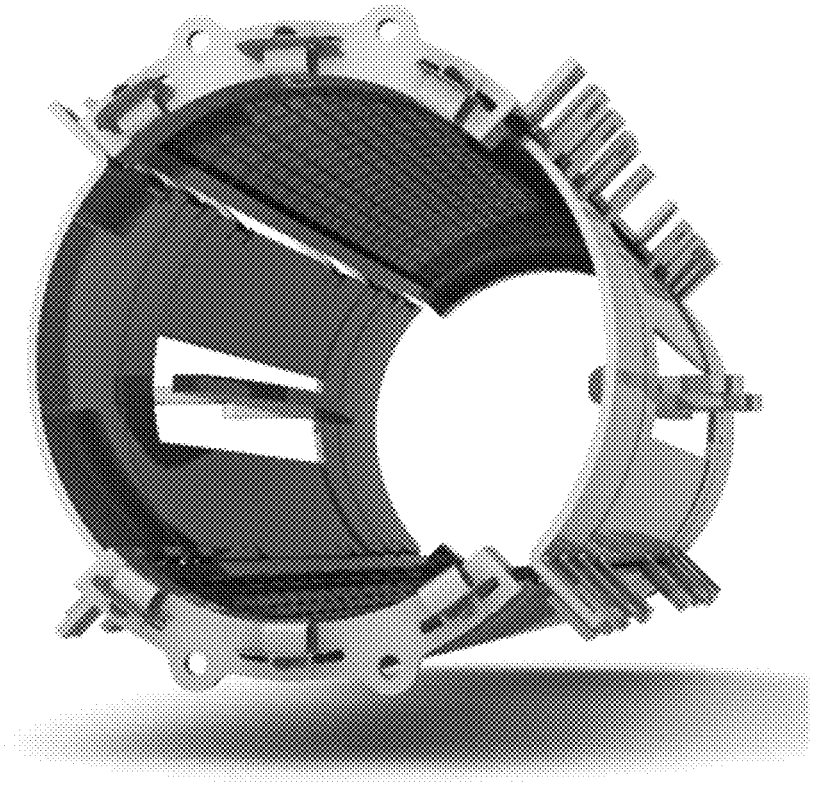
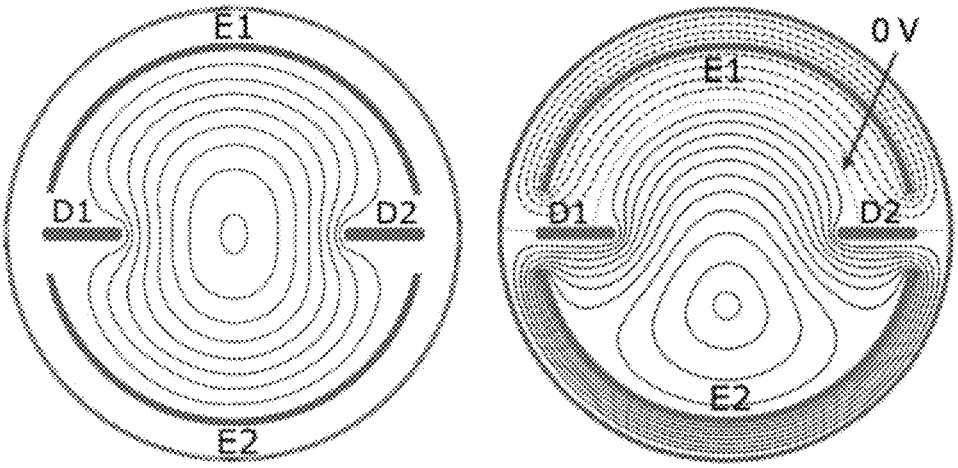
Fig.8

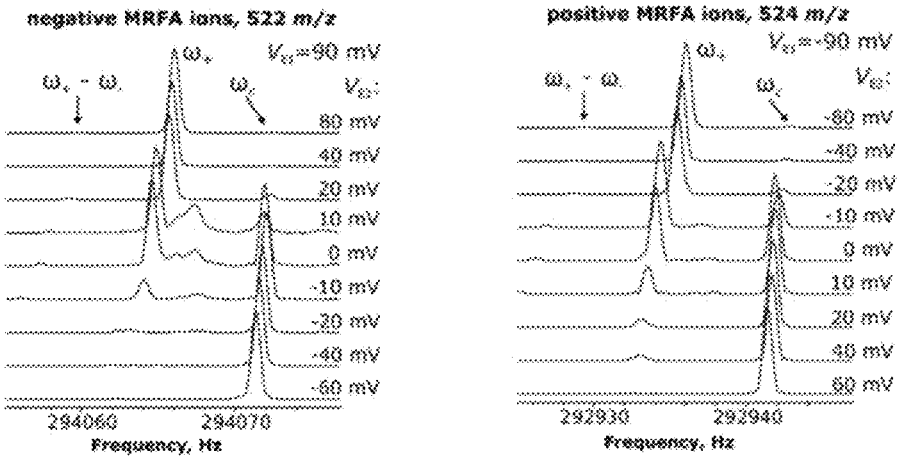
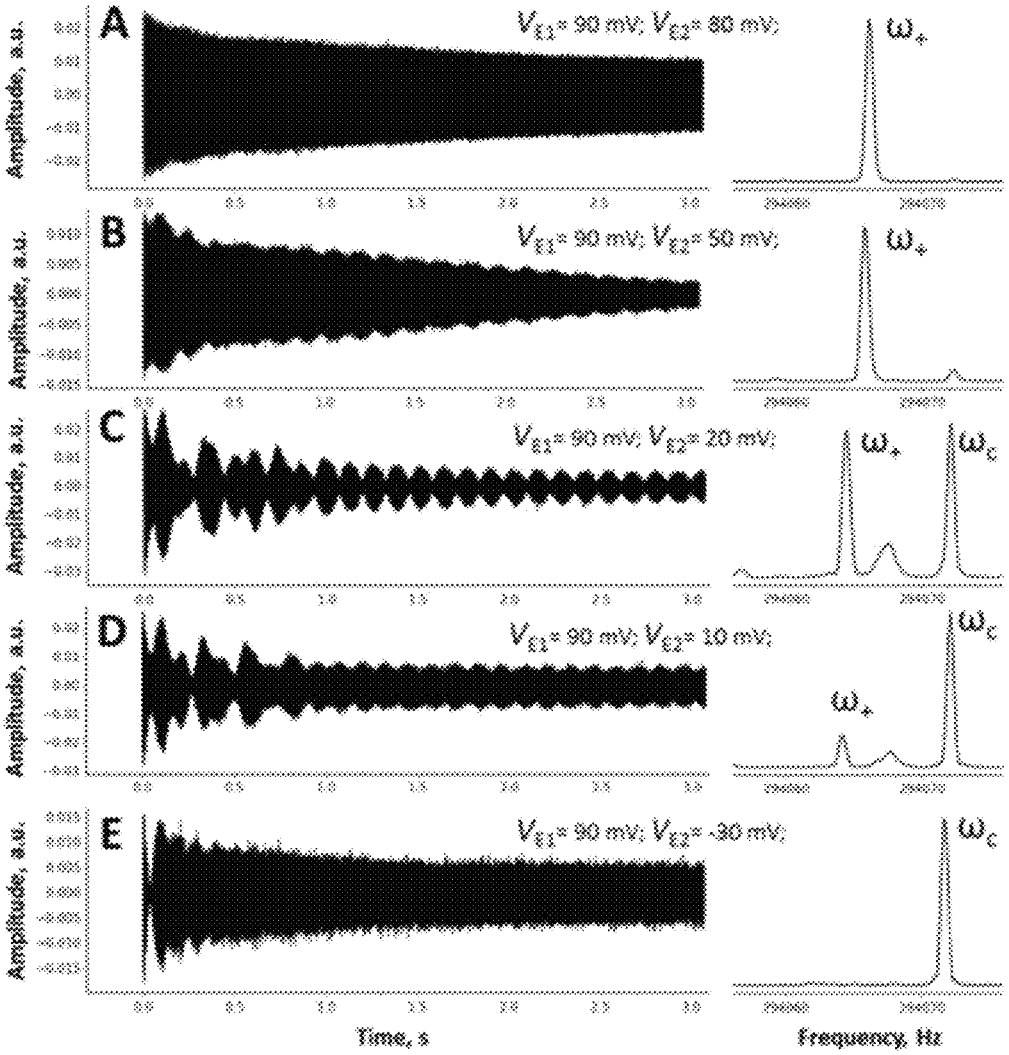
Fig.10

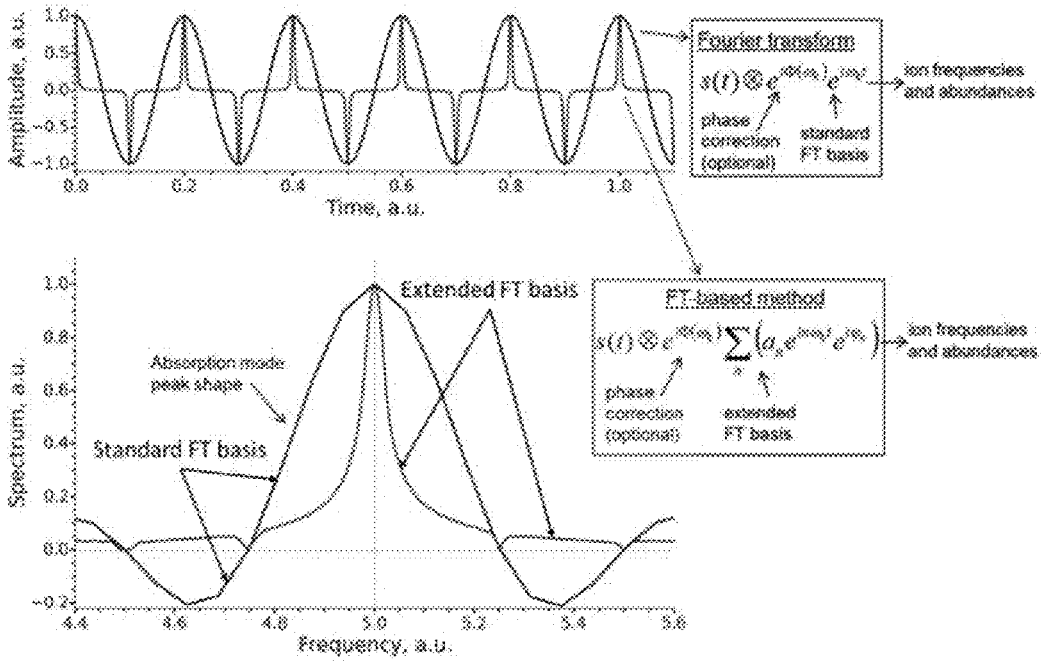
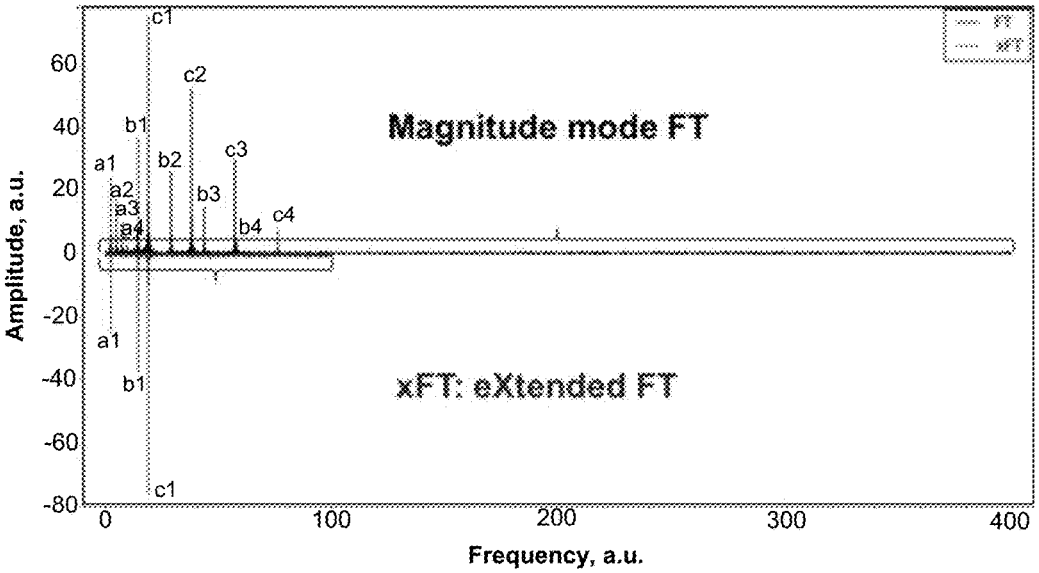
Fig.15

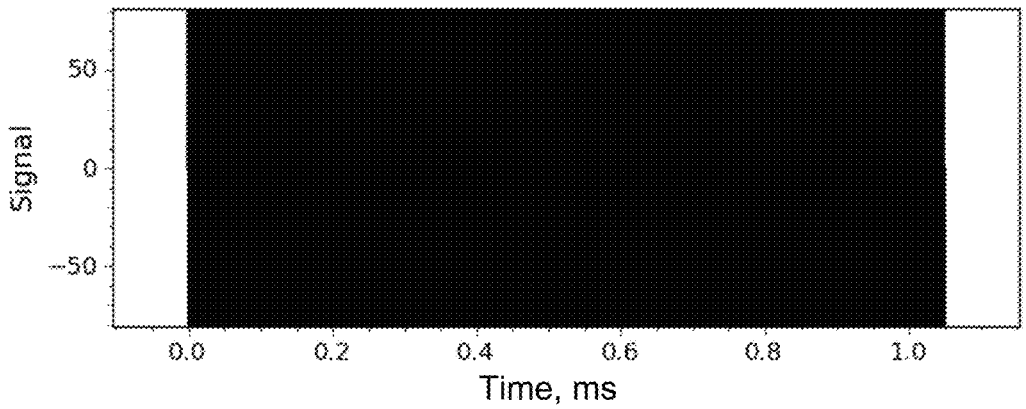
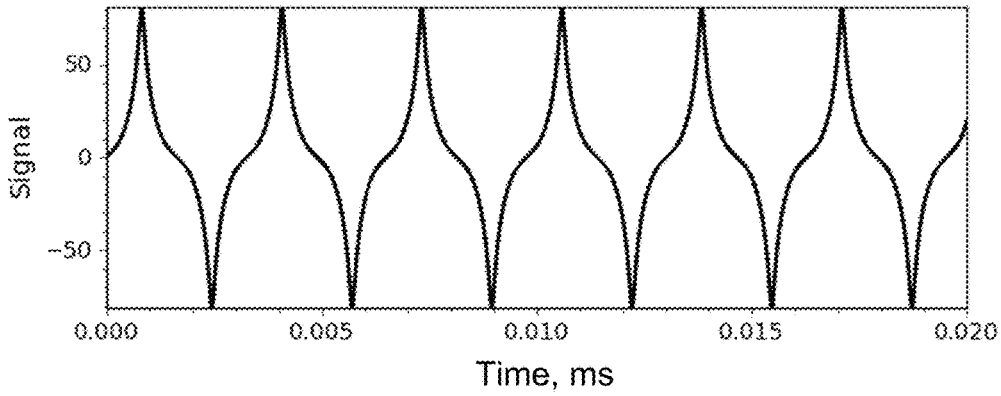
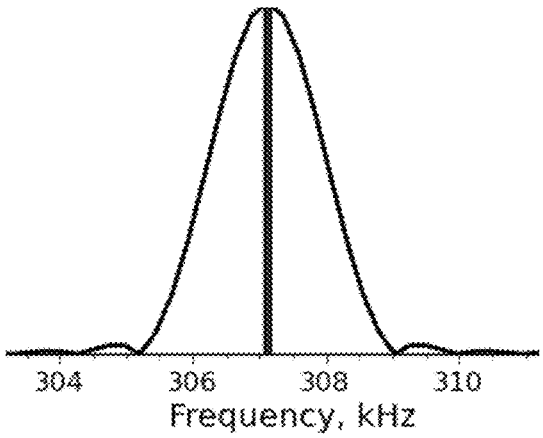
Fig.18a

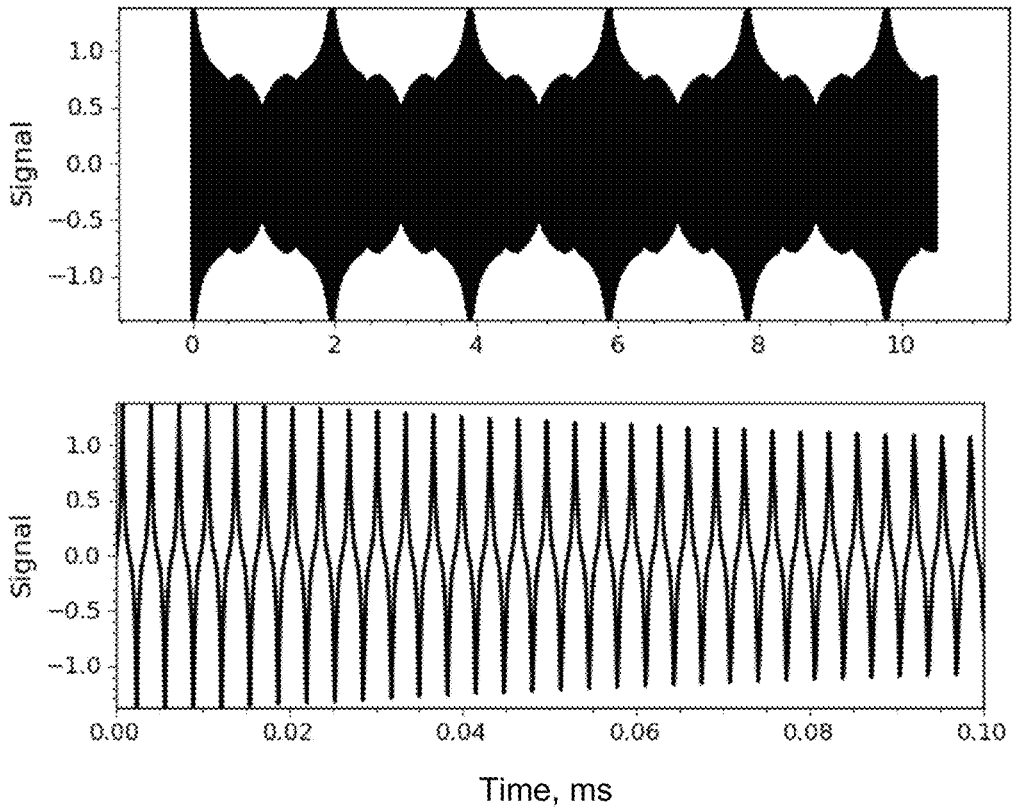
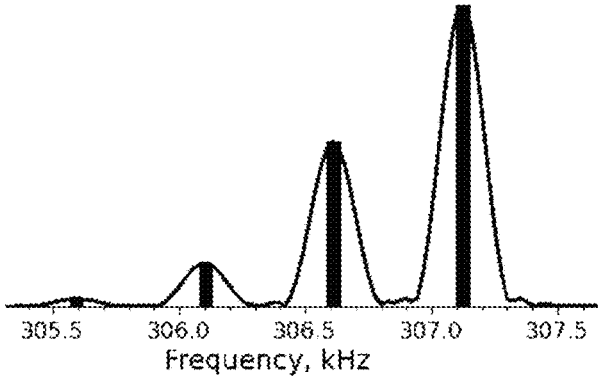
Fig.18c

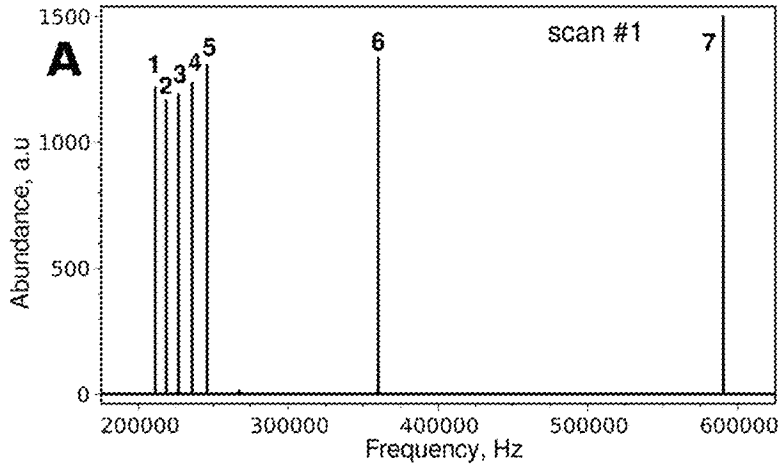

B $$\begin{cases} \varphi_i(t) = \varphi_i(0) + \omega_i t \\ \varphi_i(0) = \tilde{\varphi}_i(0) + 2\pi n_i \end{cases}$$

$i \in \{1, N\}$, $n_i = 0, \pm 1, \ldots$, $\tilde{\varphi}_i(0) \in \{0, 2\pi\}$ $$0 = \tilde{\varphi}_j(0) - \tilde{\varphi}_i(0) + 2\pi k + (\omega_j - \omega_i) t_{ij},$$

$i, j \in \{1, N\}$, $i \neq j$: $k = 0, \pm 1$ $$t_{ij} = -\frac{\tilde{\varphi}_j(0) - \tilde{\varphi}_i(0) + 2\pi k}{(\omega_j - \omega_i)}, \; k = 0, \pm 1$$

$t_c$ = mean $\{t_{ij}\}$ $\sigma$ = stdev $\{t_{ij}\}$

| Pair of peaks | | t, s | | |
|---|---|---|---|---|
| | | k=0 | k=1 | k=-1 |
| 1 | 2 | 2.839E-6 | -1.342E-4 | 1.399E-4 |
| 1 | 3 | 2.838E-6 | -6.209E-5 | 6.776E-5 |
| 1 | 4 | 2.825E-6 | -3.802E-5 | 4.367E-5 |
| 1 | 5 | 2.828E-6 | -2.594E-5 | 3.160E-5 |
| 1 | 6 | 2.780E-6 | -3.952E-6 | 9.512E-6 |
| 1 | 7 | -2.480E-8 | -2.667E-6 | 2.618E-6 |
| 2 | 3 | 2.837E-6 | -1.205E-4 | 1.262E-4 |
| 2 | 4 | 2.819E-6 | -5.535E-5 | 6.099E-5 |
| 2 | 5 | 2.825E-6 | -3.359E-5 | 3.924E-5 |
| 2 | 6 | 2.777E-6 | -4.302E-6 | 9.856E-6 |
| 2 | 7 | -8.110E-8 | -2.775E-6 | 2.613E-6 |
| 3 | 4 | 2.802E-6 | -1.073E-4 | 1.129E-4 |
| 3 | 5 | 2.819E-6 | -4.885E-5 | 5.449E-5 |
| 3 | 6 | 2.773E-6 | -4.737E-6 | 1.028E-5 |
| 3 | 7 | -1.463E-7 | -2.901E-6 | 2.608E-6 |
| 4 | 5 | 2.835E-6 | -9.452E-5 | 1.002E-4 |
| 4 | 6 | 2.771E-6 | -5.289E-6 | 1.083E-5 |
| 4 | 7 | -2.219E-7 | -3.047E-6 | 2.603E-6 |
| 5 | 6 | 2.766E-6 | -6.022E-6 | 1.155E-5 |
| 5 | 7 | -3.133E-7 | -3.223E-6 | 2.596E-6 |
| 6 | 7 | -1.837E-6 | -6.187E-6 | 2.513E-6 |

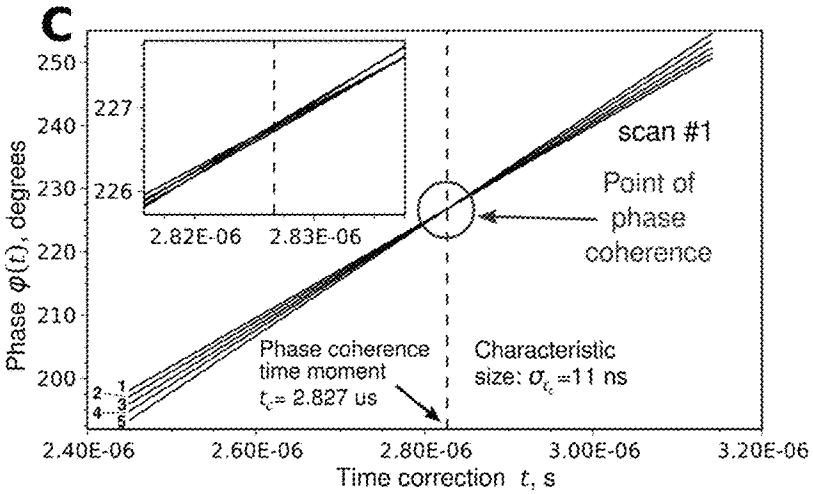

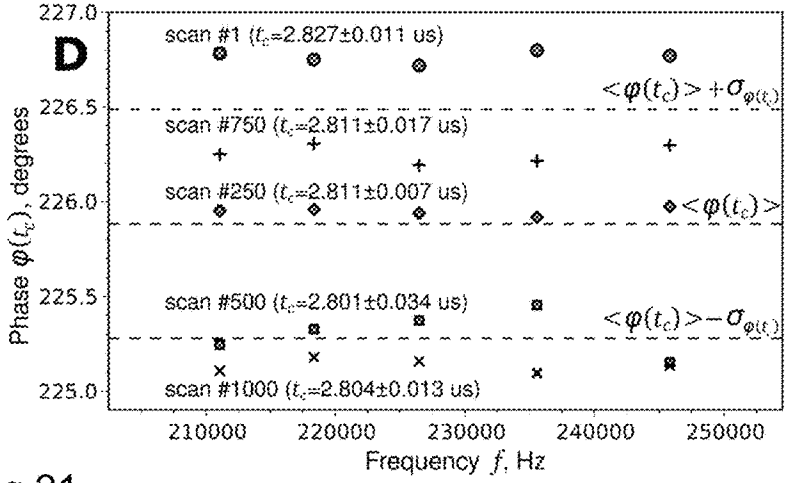

Fig.21

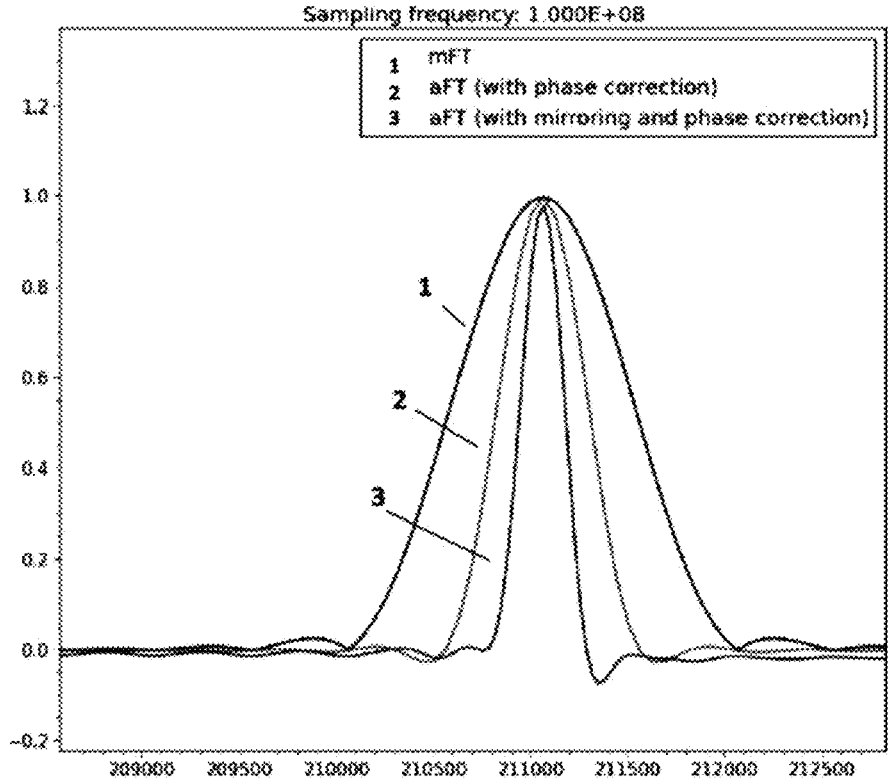
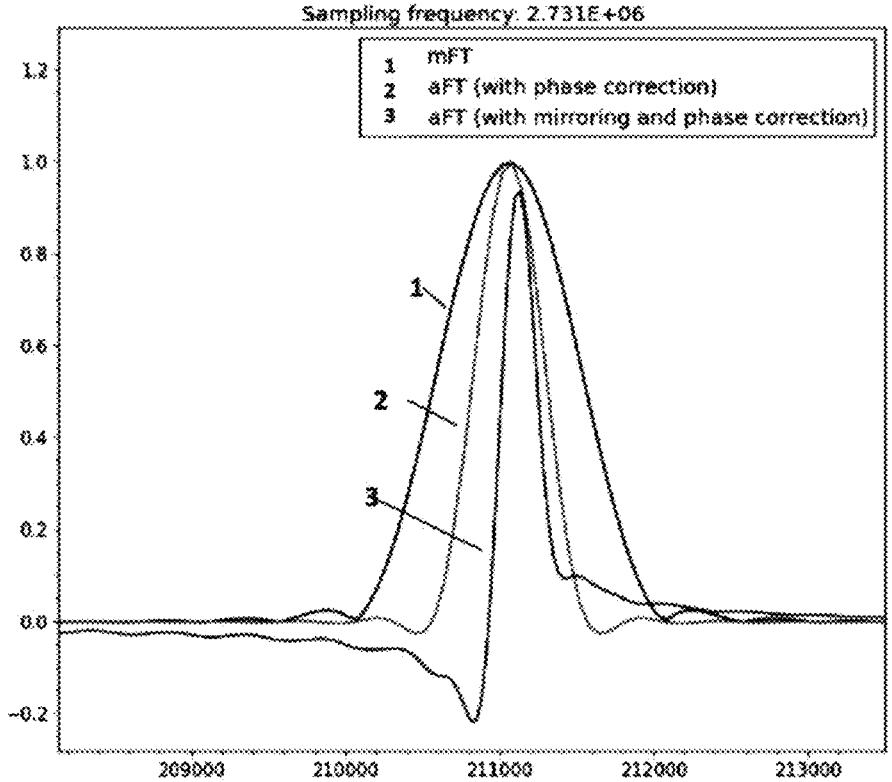
Fig.22

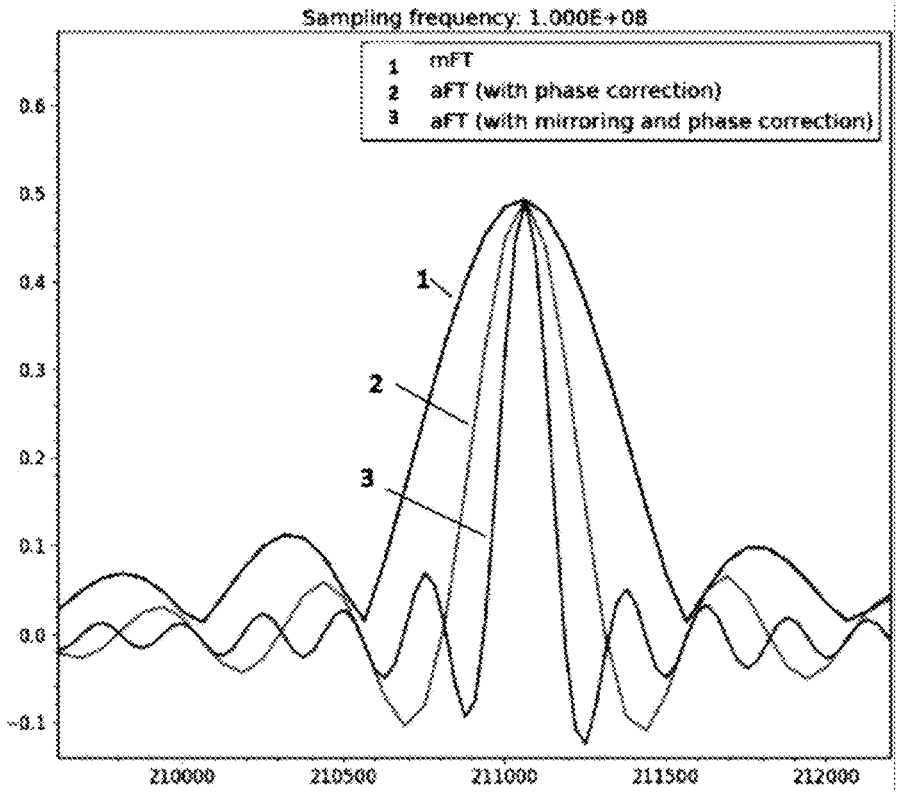
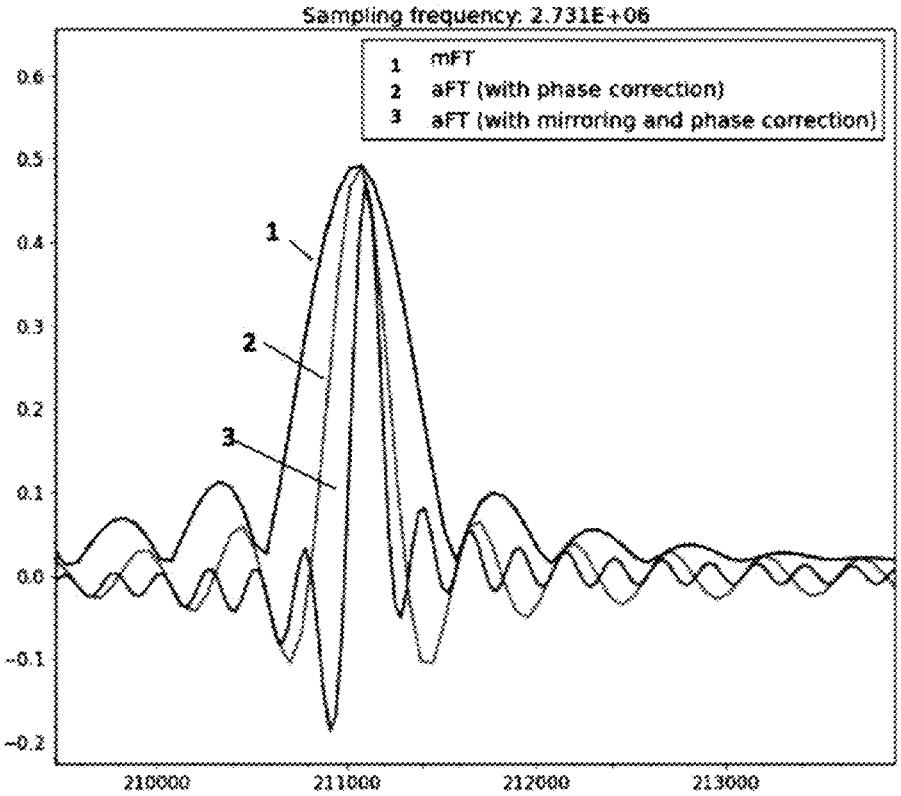
Fig.23

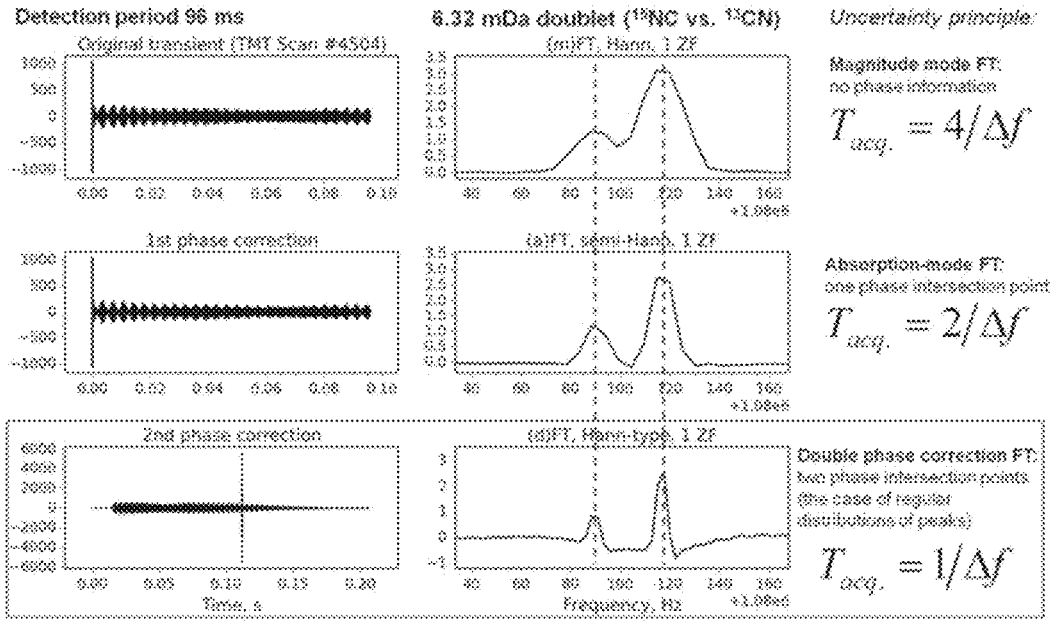
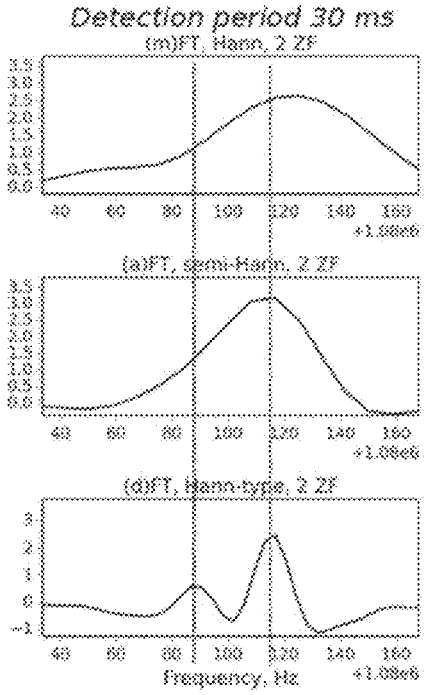
Fig.25

DEVICE AND METHOD FOR ION CYCLOTRON RESONANCE MASS SPECTROMETRY

CROSS REFERENCE TO RELATED APPLICATIONS

The present application is a U.S. national stage application of PCT/IB2015/052708 filed on Apr. 14, 2015 designating the United States, and claims foreign priority to International patent application PCT/IB2014/060709 filed on Apr. 14, 2014, the contents of both documents being herewith incorporated by reference in their entirety.

FIELD OF INVENTION

The invention relates generally to ion cyclotron resonance mass spectrometry and, more particularly, to design and performance of ion traps for ion cyclotron resonance mass spectrometry, as well as to allied signal processing.

PRIOR ART

Mass spectrometry (MS) is one of the most sensitive and selective analytical techniques for molecular structural and quantitative analysis. To provide molecular level information on samples from solid, liquid, or gas phase state, it is required to first transform molecules into ions, then to separate the formed ions by their mass-to-charge ratios, m/z, and finally record the abundance of each species as a function of m/z values. The main analytical characteristics of mass spectrometric techniques include resolving power (or resolution), mass accuracy, dynamic range, and acquisition rate (throughput). Resolving power, or resolution, refers to an ability of a mass spectrometer to distinguish molecular species that are close in their m/z values. Today, the major application areas of MS are in life, pharmaceutical, clinical, environmental, material, and forensic sciences. High resolving powers are needed to analyze complex molecular mixtures and to provide required levels of mass measurement accuracy. The complex molecular mixtures here also means analysis of isotopic fine structures of biomolecules, specifically peptides and proteins, as well as analysis of isotopic distribution of large biomolecules, e.g., proteins. For example, comprehensive analysis of crude oils and crude oil fractions requires the most outstanding levels for several analytical characteristics of a mass spectrometer, including resolving power, mass accuracy, and dynamic range. Modern mass spectrometry has already revolutionized the way we consider molecular structural analysis nowadays, but the extreme sample complexity in many cases still cannot be addressed even by the most sophisticated MS instruments.

Fourier transform mass spectrometry (FTMS) is the leading mass spectrometric technology in terms of resolving power and mass accuracy. An FTMS instrument allows one to record a time-domain (transient) signal induced by periodic ion motion in electromagnetic field over long, up to minutes, periods of time. Typically, thus measured time-domain signals are comprised of sinusoidal components corresponding to ions with different m/z values. Each of these components is characterized by its amplitude, frequency, phase, and, optionally, decay rate. Transient signals can be transformed into frequency (Fourier) spectra using Fourier transformation (FT). Other methods of signal processing, e.g., filter-diagonalization method (FDM) or least-squares fitting (LSF), are also applicable for measurements of the amplitude, frequency, and phase parameters in question. The known relations of periodic ion motion frequency and m/z values, allow converting the measured frequencies into corresponding m/z values, thus providing a mass spectrum of analyzed ions. Calibration of mass spectra using ions with a priori known m/z provides accurate mass measurements. Specifically, low-ppm and sub-ppm mass accuracy levels are readily achievable nowadays for analysis of even very complex samples such as the human proteome and petroleum. The resolving power of FTMS is directly proportional to the transient duration. The two main FTMS instruments nowadays are Fourier transform ion cyclotron resonance mass spectrometer (FT-ICR MS) and an Orbitrap FTMS. The former employs static magnetic field for ion trapping and periodic ion motion development, whereas the latter uses electrostatic field. High magnetic field FT-ICR MS provides the superior analytical performance, which is crucial for a number of applications, including those in environmental and life sciences. Magnetic fields of 7-15 T are nowadays commercially available, whereas the record 21 T superconducting magnets have been recently implemented for FT-ICR MS in the national MS facilities in the USA.

In FT-ICR MS, ions are analyzed in an ICR ion trap located in a static, preferably homogenous, magnetic field. Ions are usually generated externally to the magnetic field and are transferred to the ICR ion trap by pulsed injection of well-confined ion packets. The ionization technique employed most commonly is electrospray ionization (ESI), which produces multiply-charged ions. Once the ions are transferred into the ICR ion trap, they are trapped within the axial borders of the ion trap by application of a static electric field (trapping field) in the axial direction towards (positive ions) or inwards (negative ions) the ion trap's center. In turn, radial confinement of ions is naturally achieved with magnetic field, which is directed along the ICR trap's axis of symmetry. An RF electric potential is applied to the excitation electrodes in order to induce a coherent motion of ions and to increase the characteristic size of ion trajectories. As such, when the excitation frequency matches the resonance frequency of ions with a given m/z, the corresponding ion cloud starts inducing periodic ion current flowing through the detection circuitry. After the excitation field is switched off, ions keep oscillating under the influence of the total Lorentz force due to both the magnetic and electrical fields.

The angular frequency of ion rotation is thus specific for each m/z value and is recorded for further transformation into the frequency and then to mass spectra. In the absence of a radial component of the electric field in the ICR ion trap, the ion will rotate with a constant angular frequency, known as the unperturbed, or pure, cyclotron frequency, given that the translational motion of the ion is not excited. This angular frequency is described by the well-known formula for the ion cyclotron frequency:

$$\omega = \frac{q}{m}B,$$

which shows that the unperturbed cyclotron frequency is defined by the ion's m/q mass m to charge q ratio value and is directly proportional to the magnetic field strength B. However, due to the trapping electric field, the pure cyclotron frequency cannot be measured directly. Instead, the measured quantity in FT-ICR MS is the so-called reduced cyclotron frequency, which depends on the amplitude and spatial distribution of the trapping electric field. A theoretical relation between the reduced cyclotron frequency and pure cyclotron frequency is available, allowing the pure cyclotron frequency to be estimated on the basis of the measured reduced cyclotron frequency in order to obtain the m/z value of interest.

The FT-ICR MS resolving power is directly proportional to the (reduced) ion cyclotron frequency. Therefore, increasing magnetic field strength leads to improved resolving power performance in FT-ICR MS. The particular property of ion detection in FT-ICR MS is in the wide aperture (large azimuthal angle, typically 90 degrees) detection electrodes employed for induced current signal generation.

Overview articles on ICR and Orbitrap Fourier transform mass spectrometry are, for example: Marshall, A. G.; Hendrickson, C. L.; Jackson, G. S. "Fourier Transform Ion Cyclotron Resonance Mass Spectrometry: A Primer" *Mass Spectrom. Rev.* 1998, 17, 1-35; Marshall, A. G.; Hendrickson, C. L.: High-resolution mass spectrometers. In *Annual Review of Analytical Chemistry* 2008, 1, 579-599; Scigelova, M.; Hornshaw, M.; Giannakopulos, A.; Makarov, A.: Fourier transform mass spectrometry. *Molecular & Cellular Proteomics* 2011, 10, M111.009431; Xian, F.; Hendrickson, C. L.; Marshall, A. G.: High resolution mass spectrometry. *Analytical Chemistry* 2012, 84, 708-719; Zubarev, R. A.; Makarov, A. Orbitrap mass spectrometry. *Analytical Chemistry* 2013, 85, 5288-5296.

DISCUSSION OF PROBLEMS OF THE PRIOR ART

Based on the prior art, one may distinguish the following factors limiting the analytical characteristics in state-of-the-art FT-ICR MS with a standard ICR ion trap:

a) After RF ion excitation, motion of all ions with the same m/z value is nearly coherent with respect to their reduced cyclotron frequency rather than pure (unperturbed) cyclotron frequency, thus limiting the mass accuracy given the limited precision of the theoretical equation relating these two frequencies when using a standard ICR ion trap.

b) As efficiency of the trapping and excitation electric fields to produce a highly coherent state for motion of ions with the same m/z is limited, so is the sensitivity which can be achieved in measurements using a standard ICR ion trap.

c) Contribution of each individual ion into the transient signal is defined by induced charge integration over the wide aperture of the detection electrodes of a standard ICR ion trap, thus limiting resolution with which different m/z can be measured with the standard FT methods.

Therefore, the inherent limitation of the FT-ICR MS is the relatively long time required for acquisition of high-resolution mass spectra, whereas the MS applications nowadays not only require substantially higher resolving power obtained routinely than ever before but oftentimes also set the very tight time constraints for the experiment. The following application areas of high resolution MS are in a particularly substantial need of achieving higher resolution faster: (i) Petroleomics, which represents the mass spectrometric analysis of extremely complex mixtures of small molecules, e.g., crude oils, biofuels and dissolved organic matter from environmental samples, requires resolving powers of 300 k and more in the 100-1500 Da mass range which translates into 5-10 seconds long FT-ICR MS transient signals even with strong magnets of 10-15 T. Additional benefit for complex mixture analysis may be provided by increased resolving power achieved in high m/z range, above 1000 m/z; (ii) Metabolomics, which represents analysis of complex mixtures of small (bio)molecules. These complex mixtures can be typically separated by liquid chromatography and infused into a mass spectrometer for only a several seconds period of time per molecule. Due to the extremely high complexity of the metabolomics samples, fast high-resolution mass spectrometric analysis is essential to provide a comprehensive analysis of the samples; (iii) Proteomics, which represents the mass spectrometric analysis of complex mixtures of high molecular weight biological molecules that constitute, for example human, proteome, requires at least 60-100 k resolving power in the mass/charge range of at least 200-2000 m/z and can be considered in bottom-up, middle-down, and top-down approaches. In bottom-up proteomics, the specified resolving power should be obtained in as short as possible period of time due to the fast, few seconds, proteolytic peptide elution from the chromatographic column, and peptide co-elution. Importantly, the slow rate of high resolution data acquisition drastically reduces the identified protein dynamic range of concentration in a sample. Thus, a significant and biologically crucial part of proteins rarely gets identified in the proteomics experiment. Middle-down proteomics is similar to the bottom-up approach with the main difference of employing larger enzymatically produced peptides. More specifically, middle-down proteomics aims to analyze 3-15 kDa enzymatically-derived peptides. Typically, higher resolution than in bottom-up proteomics is required. The reasons for achieving higher resolution faster are similar to bottom-up approach, with an added complexity of higher density product ion mass spectra in tandem mass spectrometry of large multiply charged peptides. The top-down proteomics deals with chromatographically separated (1-5 min elution time per peak at the current performance of chromatographic separation) intact proteins and large protein fragments (MW 10-200 kDa and above) and requires resolving power of about 200 k which can be obtained at an expense of a signal/noise ratio due to the long transient acquisition or is not readily obtained at all due to the high complexity of the gas-phase ion mixtures that need to be simultaneously detected and the difficulty of large ion manipulation with electric and magnetic fields in the gas phase. Intact protein analysis, as a first step of any type of top-down proteomics experiment, requires resolving powers 200-500 k to resolve isotopic clusters of large proteins and, even more importantly, separate proteoforms (refers to protein isoforms and species that arise from four major sources: multigene families, alternative splicing, coding polymorphisms, and post-translational modifications). Fast transient signal decay and long time between beats of the signal due to high precursor ion charge imply that efficient signal recording time is limited to several seconds; and (iv) Other areas, such as ion mobility and imaging MS: a number of MS-based applications would benefit from high speed acquisition of high resolution data. Both technical (speed of analysis) and analytical (new information on the samples) advantages are expected.

Typically, the transient time-domain signals are expanded into a set of sinusoidal functions by the Fourier transformation (FT), which limits the obtained resolving power per unit of time. Therefore, to achieve the required resolution, a large number of periods, or a long acquisition time, is needed. Indeed, the resolving power in FT-ICR MS increases approximately linearly as a function of time or the number of ion rotation periods:

$$R = \frac{dR}{dt}t,$$

where $$\frac{dR}{dt} = \frac{f}{C}$$

is approximately constant for a given value of ion frequency f. The derivative $$R' = \frac{dR}{dt},$$

which can be considered as a "resolving power increase rate", characterizes the speed of data acquisition for a specific experimental configuration. In a typical FT-ICR MS with near-sinusoidal transients, the parameter C is about 0.5-2 and depends on the apodization method selected and data representation mode (magnitude or absorption FT). The resolving power R in a given period of time t may thus be characterized by the number of turns, N=ft, made by an ion during this time: R=R't=N/C. Therefore, to increase the resolving power one needs to either increase the number of turns ion makes in time unit, e.g., increase magnetic field strength, or increase parameter R', e.g., by measuring higher harmonics of ion rotation frequency by employing multiple frequency detection schemes. However, the already verified and envisioned FT-ICR MS measurements with frequency multiples detection aim at increasing the parameter R' in 2-5 times at most and provide similar near-sinusoidal transients. Even then, up to now the frequency multiples detection methods have not been efficiently implemented in practice. Therefore, one of the major disadvantages of the prior art is in the slow rate of resolution increase with time in FT-ICR MS.

The additional disadvantages of the prior art refer to the limitations of the current implementations of the ICR ion traps. Specifically, large (wide aperture) detection electrodes required for induced current-based ion detection, limit the flexibility of implementation of advanced ion excitation and detection schemes. For example, quadrupolar ion excitation would be beneficial for improved performance of ion excitation. However, its current implementation with wide aperture excitation and detection electrodes requires the use of an external switching electronics device that would connect excite RF potential to a pair of electrodes during the excitation event and then switch to reception of induced current signal on the same pair of electrodes during the detection event. Such implementation is technically challenging and introduces electronic noise into the system.

Furthermore, all FT-ICR MS (bio)molecular mass measurements are performed using the reduced cyclotron frequency component as the measured quantity, as described above. The reduced cyclotron frequency is generally described by an unperturbed cyclotron frequency minus magnetron frequency. The reduced cyclotron frequency is thus a function of electric field in ICR ion trap, e.g., trapping electric field. Therefore, mass accuracy in FT-ICR MS suffers from a certain dependence of this reduced cyclotron frequency on electric fields present in the ICR ion trap during ion detection. To provide the most accurate mass measurements, the trapping potentials are thus lowered to as little values as possible (typically about 1 V) during ion detection event. However, reduction of a trapping ability in turn reduces the sensitivity of mass measurements (ion loss) specifically when high resolutions are to be achieved (long detection time) or energetic ions are formed inside of the ICR ion trap, e.g., in tandem-in-time mass spectrometry event, such as electron capture dissociation. Therefore, there is a strong incentive to record an unperturbed cyclotron frequency, for which dependence on electric field is substantially reduced, instead of a reduced cyclotron frequency in a routine (bio)molecular mass measurements. However, the robust and reproducible ways to do so have not been presented yet.

Finally, Fourier transform (FT) signal processing applied to the acquired time-domain signals (transients) further limits achievable resolution performance due to the FT uncertainty principle and harmonics generation in frequency (mass) spectrum from non-sinusoidal transients. According to the FT uncertainty principle, to achieve a given resolution in a frequency (mass) spectrum, the minimum required transient duration is inversely proportional to the minimum frequency spacing between the peaks in a selected frequency window (total frequency spectrum). To overcome this limitation, signal processing methods with a different uncertainty principle can be employed. Specifically, uncertainty principle of super-resolution signal processing methods is such that the minimum required transient duration is inversely proportional to an average frequency spacing between the peaks in a given frequency window. Among the super-resolution signal processing methods are parameter estimators—filter diagonalization method (FDM) and least-squares fitting (LSF). To address the second limitation of FT processing, signal processing methods aiming for analysis of transients with non-sinusoidal components are to be developed. Specifically, these methods are to use the properties of non-sinusoidal transients to increase a resolution per unit of detection time or to remove unwanted harmonics from the frequency (mass) spectra.

OBJECTIVE OF THE INVENTION

The aim of this invention is to increase the performance of mass spectrometry by the use of a novel configuration of electric fields in the ICR ion traps, including trapping, excite, and detect fields, as well as allied signal processing methods. This goal is suggested to be achieved via implementation of narrow aperture detection electrodes instead of the currently employed wide aperture detection electrodes in the construction of ICR ion traps. The use of narrow aperture detection electrodes improves the flexibility of ICR ion trap designs to ease the implementation of high order (for example: quadrupolar, quadrature and octopolar) ion excitation and frequency multiples detection on one hand, and to realize large bandwidth and quadrupolar ion detection on the other hand. One of the main performance improvement targets is the increase of the time-increment of resolving power compared to that provided by the most advanced mass spectrometers today, to achieve:

(i) high resolving power in a short acquisition time period. Important and crucial for a number of applications in proteomics, petroleomics, metabolomics, imaging, etc.;

(ii) ultra high resolving power in a long acquisition time period. Important to open new frontiers in molecular analysis, e.g., molecular identification by isotopic fine structure, isomer differentiation by the chemical bonds energy, etc.

The here proposed design of the ion traps for ICR mass spectrometry allows to acquire a transient from ions where position of a given ion is determined in each moment of time better than it is currently performed. In a preferred embodiment case, the acquired transient components are asymptotically close to sha-functions. Therefore, tailored advanced signal processing methods, e.g., based on super-resolution and extended basis Fourier transform signal processing, are to be applied for efficient processing of the acquired transients, to increase the performance of conventional magnitude or absorption mode fast Fourier transform (FFT) signal processing of these transients. Finally, another important improvement objective is in the increased mass accuracy of the routine mass analysis via detection of the unperturbed ion cyclotron frequency instead of the commonly acquired reduced cyclotron frequency information.

In a first aspect, the invention provides a method for measuring mass over charge (m/z) ratios of ions in an ion trap of an ion cyclotron resonance mass spectrometer, comprising at least narrow aperture detection electrodes.

In a preferred embodiment, the method further comprises selecting excitation electrodes of a variable angular dimension in a range between 1° and 180°.

In a further preferred embodiment, the method further comprises selecting a narrow aperture detection electrodes thickness between 1 nm and 10 mm.

In a further preferred embodiment, the method further comprises selecting a narrow aperture detection electrodes width between 1 nm and 10 cm.

In a further preferred embodiment the narrow aperture detection electrodes are positioned radially inward of the ICR ion trap.

In a further preferred embodiment, the method further comprises employing 1-1000 narrow aperture detection electrodes.

In a further preferred embodiment, the method further comprises positioning narrow aperture detection electrodes on an equipotential plane of an ion excitation field, with a surface of the detection electrodes being normal to unperturbed excitation field lines.

In a further preferred embodiment, the method further comprises employing 4 narrow aperture detection electrodes and 4 wide aperture excitation electrodes.

In a further preferred embodiment, the method further comprises using the 4 wide aperture excitation electrodes for excitation thereby realizing quadrupolar or quadrature excitation.

In a further preferred embodiment, the method further comprises using the 4 narrow aperture detection electrodes for detection thereby realizing quadrupolar ion detection.

In a further preferred embodiment, the method further comprises using the 4 wide aperture excitation electrode for excitation, using the 4 narrow aperture electrodes for detection and thereby realizing both quadrupolar ion detection and quadrupolar or quadrature ion excitation.

In a further preferred embodiment, the method further comprises locating a pre-amplifier inside of a magnetic field in close proximity to the narrow aperture detection electrodes.

In a further preferred embodiment, the method further comprises shaping the narrow aperture detection electrodes according to any one of the list comprising at least curved, perpendicular and oval forms in either flat or non-flat configurations.

In a further preferred embodiment, the method further comprises employing advanced signal processing based on super-resolution methods, including pattern recognition methods, or based on Fourier transform to process time-domain data of thus recorded ion signal.

In a further preferred embodiment, the method further comprises employing a filter diagonalization method (FDM) as a super-resolution method of signal processing.

In a further preferred embodiment, the method further comprises employing least-squares fitting (LSF) as a super-resolution method of signal processing.

In a further preferred embodiment, the method further comprises employing signal processing methods considering a given dependence of intensities of harmonics on the harmonic order.

In a further preferred embodiment, the method further comprises performing signal processing based on the count of periods of ion signals in a transient signal as a function of time.

In a further preferred embodiment, the method further comprises maximizing the intensities of peaks corresponding to an unperturbed cyclotron frequency with the applied electric potentials to the detection, excitation, and trapping electrodes of the ion trap, and minimizing the intensity of peaks corresponding to the reduced cyclotron frequency and other interharmonics.

In a further preferred embodiment, the method further comprises applying offset potentials to the detection and excitation electrodes to increase the intensities of peaks corresponding to the unperturbed cyclotron frequency.

In a further preferred embodiment, the method further comprises measuring unperturbed cyclotron frequency using dipolar or quadrupolar ion detection and quadrupolar or dipolar excitation applied to opposite or adjacent excitation electrodes with or without additional offset potentials applied to the excitation and/or detection electrodes.

In a further preferred embodiment, the method further comprises exciting ions to a sufficiently large orbit to generate periodic non-sinusoidal time-domain signals.

In a further preferred embodiment, the method further comprises coating the surfaces of narrow aperture detection electrodes by resistive material or shielding by conducting electrodes under a certain potential or grounded to generate broadband time-domain signals.

In a further preferred embodiment, the method further comprises employing advanced signal processing to process thus generated signals from ions.

In a further preferred embodiment, the method further comprises employing extended Fourier transform basis signal processing to process thus generated signals from ions in order to remove unwanted harmonics or increase the resolution.

In a further preferred embodiment, the method further comprises applying extended Fourier transform basis signal processing to broadband signals acquired with other devices.

In a further preferred embodiment, the method further comprises increasing trapping electric potentials applied to the ion trap from a typical 1 V up to 200 V, either positive or negative values, with detection of unperturbed cyclotron frequency or reduced cyclotron frequency.

In a further preferred embodiment, the method further comprises employing 8 narrow aperture detection electrodes and 8 wide aperture excitation electrodes.

In a further preferred embodiment, the method further comprises using the 8 excitation electrodes for excitation, thereby realizing octopolar ion excitation.

In a further preferred embodiment, the method further comprises using the 8 detection electrodes for detection, thereby realizing two simultaneous quadrupolar ion detections or four simultaneous dipolar ion detections, or their combination.

In a further preferred embodiment, the method further comprises selecting the excitation electrodes also as narrow aperture electrodes.

In a further preferred embodiment, the method further comprises selecting a narrow aperture excitation electrodes thickness in a range between 1 nm and 10 mm.

In a further preferred embodiment, the method further comprises selecting the narrow aperture excitation electrodes width in a range between 1 nm and 10 cm.

In a further preferred embodiment, the narrow aperture excitation electrodes are positioned radially inward of the ICR ion trap.

In a further preferred embodiment, the method further comprises employing 1-1000 narrow aperture excitation electrodes.

In a further preferred embodiment, the method further comprises reducing in size to 10-40 mm the total dimensions of an ion trap with narrow aperture detection or excitation electrodes for ion cyclotron resonance mass spectrometry.

In a further preferred embodiment, the method further comprises realizing simultaneously two or more dipolar or quadrupolar ion detections.

In a further preferred embodiment, the method further comprises using information from simultaneously acquired ion signals for improved signal processing, using correlation analysis between thus recorded transients or for determination of a phase function.

In a further preferred embodiment, the method further comprises reducing or not applying offset potentials to excitation and detection electrodes during ion detection.

In a second aspect, the invention provides a device for measuring mass over charge (m/z) ratios of ions in an ion trap of an ion cyclotron resonance mass spectrometer, comprising at least narrow aperture detection electrodes.

In a further preferred embodiment, excitation electrodes are of a variable angular dimension in a range between 1-180°.

In a further preferred embodiment, a narrow aperture detection electrodes thickness is between 1 nm and 10 mm.

In a further preferred embodiment, a narrow aperture detection electrodes width is between 1 nm and 10 cm.

In a further preferred embodiment, the device further comprises narrow aperture detection electrodes positioned radially inward of the ICR ion trap.

In a further preferred embodiment, the device further comprises between 1 and 1000 narrow aperture detection electrodes.

In a further preferred embodiment, the device further comprises narrow aperture detection electrodes positioned on an equipotential plane of an ion excitation field, with a surface of the detection electrodes being normal to the unperturbed excitation field lines.

In a further preferred embodiment, the device further comprises exactly 4 narrow aperture detection electrodes and 4 wide aperture excitation electrodes.

In a further preferred embodiment, the 4 excitation electrodes are configured to be used for excitation, thereby realizing quadrupolar or quadrature ion excitation.

In a further preferred embodiment, the 4 detection electrodes are configured to be used for detection, thereby realizing quadrupolar ion detection.

In a further preferred embodiment, the 4 excitation electrodes are configured to be used for excitation and the 4 detection electrodes are configured to be used for detection, thereby realizing both quadrupolar ion detection and quadrupolar or quadrature ion excitation.

In a further preferred embodiment, the device further comprises a pre-amplifier located inside of a magnetic field in close proximity to the narrow aperture detection electrodes.

In a further preferred embodiment, the narrow aperture detection electrodes have a shape that corresponds to any one of the list comprising at least curved, perpendicular and oval forms in either flat or non-flat configurations.

In a further preferred embodiment, the surfaces of narrow aperture detection electrodes are coated by resistive material or shielded by conducting electrodes under a certain potential or grounded to generate broadband time-domain signals.

In a further preferred embodiment, the device further comprises exactly 8 narrow aperture detection electrodes and 8 wide aperture excitation electrodes.

In a further preferred embodiment, the 8 excitation electrodes are configured to be used for excitation, thereby realizing octopolar ion excitation.

In a further preferred embodiment, the 8 detection electrodes are configured to be used for detection, thereby realizing two simultaneous quadrupolar ion detections or four simultaneous dipolar ion detections, or their combination.

In a further preferred embodiment, excitation electrodes are narrow aperture electrodes.

In a further preferred embodiment, the narrow aperture excitation electrodes thickness is between 1 nm and 10 mm.

In a further preferred embodiment, the narrow aperture excitation electrodes width is between 1 nm and 10 cm.

In a further preferred embodiment, the device further comprises narrow aperture detection electrodes positioned radially inward of the ICR ion trap.

In a further preferred embodiment, the device further comprises between 1-1000 narrow aperture excitation electrodes.

In a further preferred embodiment, the total dimensions of an ion trap with narrow aperture detection or excitation electrodes for ion cyclotron resonance mass spectrometry are reduced in size to 10-40 mm.

In a further preferred embodiment, simultaneously two or more dipolar or quadrupolar ion detections are realized.

In a further preferred embodiment, the device further comprises ion signal acquisition with sampling frequency in the range 10-1000 MHz.

In a further preferred embodiment, the inventive method further comprises comprising a finite impulse response filtering followed by downsampling of thus acquired data points using post-processing computational resources or embedded electronics to the level of 10 MHz sampling frequency or below for increased dynamic range and sensitivity in mass spectrometry.

In a further preferred embodiment, the inventive method further comprises applying a finite impulse response filtering followed by downsampling of thus acquired data points for broadband and narrowband ion signals generated with other devices.

In a further preferred embodiment of the inventive method, high performance data acquisition system provides accurate transient measurements synchronized with the mass spectrometer internal clock for accurate determination of a phase coherence point.

In a further preferred embodiment of the inventive method, improved resolving power is obtained by transient signal processing with the double phase correction algorithm described herein, for any mass spectrometer providing transient signal of ions.

In a further preferred embodiment of the inventive method, additional information on the ion signals to be resolved, e. g., ion charge state or known mass spacing between the expected ion signals, is employed to improve the accuracy of a double phase correction algorithm.

In a further preferred embodiment of the inventive method, a suitable apodization function is applied to transient signal to reduce a negative impact from baseline role in the frequency spectrum obtained with double phase correction.

In a further preferred embodiment of the inventive method, thus obtained optimized apodization function is applied to produce an absorption mode frequency (mass) spectrum (single phase correction).

In a further preferred embodiment of the inventive method, thus described method is applied to improve resolution in multiplexed protein quantitation, for example of reporter ions in 10-plex tandem mass tag (TMT) approach and neutron encoded (with mass defect between 2 and 50 mDa) peptides analyzed in the MS and MS/MS modes.

In a further preferred embodiment of the inventive method, thus described method is integrated on an FPGA board of the data acquisition electronics to provide real-time signal processing.

In a further preferred embodiment, the device of the invention comprises aperture excitation electrodes for simultaneous or consecutive excitation and detection of ions in each of the array sections.

BRIEF DESCRIPTION OF THE DRAWINGS

The invention will be better understood from the description of preferred example embodiments and in view of the figures, wherein:

FIG. 2 shows a modified version of the ICR ion trap with narrow aperture detection electrodes that are inserted inwards, in the plane where excitation field is symmetrical (equipotential plane of excitation field), inside the ICR ion trap to reach closer to the ion trajectories, if desired. The surfaces of the detection electrodes should be perpendicular to the excitation electric field. (Top panel) schematic visualization; (middle panel) drawing of an ICR ion trap with a pair of narrow aperture detection electrodes; and (bottom panel) shows its unrolled surface;

FIG. 4 shows a comparison of the potential distribution of the trapping electric field in ICR ion traps. Shown are SIMION-modeled electric potential distributions in the ICR cells with narrow aperture (curved or rectangular) detection and standard 90° excitation electrodes, as well as with standard 90° detection/excitation electrodes. Shown are the trapping potential distribution for (top panel) NADEL ICR ion trap with curved detection electrodes in the plane (left) along magnetic field and (right) perpendicular to magnetic field in the center of the ion trap when z=0 mm; (middle panel) standard cylindrical ICR ion trap. The employed simulation parameters: trapping electrodes are sustained at 1 V; excitation and detection electrodes at 0 V; all contours correspond to the range of (left) 0.1 V to 0.9 V with 0.1 V increments and (right) 0.01 V to 0.04 V with 0.01 V increments. (Bottom panel) shows SIMION-modeled axial dependencies of electric field distributions in the ICR cells with standard 90° detection/excitation electrodes, as well as with standard 90° excitation and narrow aperture detection electrodes being curved or rectangular. The employed simulation parameters: trapping electrodes at 1 V, excitation and detection electrodes at 0 V, 0.6 R is a 60% of radius value;

FIG. 7 shows a NADEL ICR ion trap with 8 (eight) electrodes that can be employed for ion excitation and 8 (eight) electrodes that can be employed for ion detection. (Top panel) shows a 3D view; (bottom panel) shows a trapping potential distribution. The envisioned use of this ICR trap is for either of quadrupolar, quadrature, adjacent, octopolar modes of ion excitation, as well as quadrupolar or dipolar ion detection with a possibility of simultaneous generation and recording of multiple transients;

FIG. 8 shows a NADEL ICR ion trap with two excitation (E1, E2) and two narrow aperture detection electrodes (D1, D2), containing trapping rings and excitation grid-electrodes. (Top panel) shows a 3D view with extended 176° excitation electrodes. SIMION-generated trapping potential distribution in this ion trap in the plane perpendicular to magnetic field at z=0 mm: (middle panel) all DC offsets are equal zero $V_{D1}=V_{D2}=V_{E1}=V_{E2}=0$ mV (contours from 0.02 to 0.16 V) and (bottom panel) $V_{D1}=V_{D2}=0$ mV $V_{E1}=-90$ mV and $V_{E2}=150$ mV (contours from −0.08 to 0.22 V). The employed simulation parameters: trapping electrodes at 5 V; all contours in 0.02 V increments;

FIG. 10 shows (top panel) the dependence of unperturbed cyclotron frequency $\omega_c$ and the reduced cyclotron frequency ω+ and its magnetron sidebands on the offset potentials $V_{E1}$ and $V_{E2}$, applied to the excitation electrodes E1 and E2 respectively, for positive and negative modes at the trapping potential of 2.5 V: $V_{E1}=-90$ mV for positive mode; $V_{E1}=90$ mV for negative mode; $V_{D1}=V_{D2}=0$ mV for both. (Bottom panel) time domain signals were experimentally acquired with negative MRFA ions at 522 m/z as a function of DC offset potential $V_{E2}$ with fixed value $V_{E1}=90$ mV. The corresponding mass spectra are shown to the right. Experimental parameters: trapping potential of 2.5 V, detection period of 3.072 s, 10 T magnetic field;

FIG. 15 shows the use of information from FIG. 14 for signal processing with Fourier transform with an extended basis constructed to (top panel) increase spectral resolution and (bottom panel) remove the unwanted harmonics;

FIGS. 18*a-c* show examples of transient signals and their corresponding frequency spectra generated with narrow aperture detection electrodes in 10 T magnetic field (SIMION calculations) obtained for (a) single monoisotopic ion with m/z=524 (b) 3 ions with m/z values of 100, 200 and 600 and (c) single ion with m/z=524 with the corresponding isotopes;

FIG. 21 illustrates the phase coherence point for ultramark calibrants analyzed with an FTMS instrument and the advantage of employing high sampling frequency, e.g. 100 MHz, to digitize a transient signal;

FIG. 22 shows the results of the application of the method of double phase correction described here to a single peak resolution in FTMS;

FIG. 23 shows the results of the application of the method of double phase correction described here to a single peak resolution in FTMS.

FIG. 25 shows the benefit of the described here method of double phase correction compared to the state-of-the-art FTMS.

DESCRIPTION OF THE INVENTION

FIGS. 1-19

Figure 1:
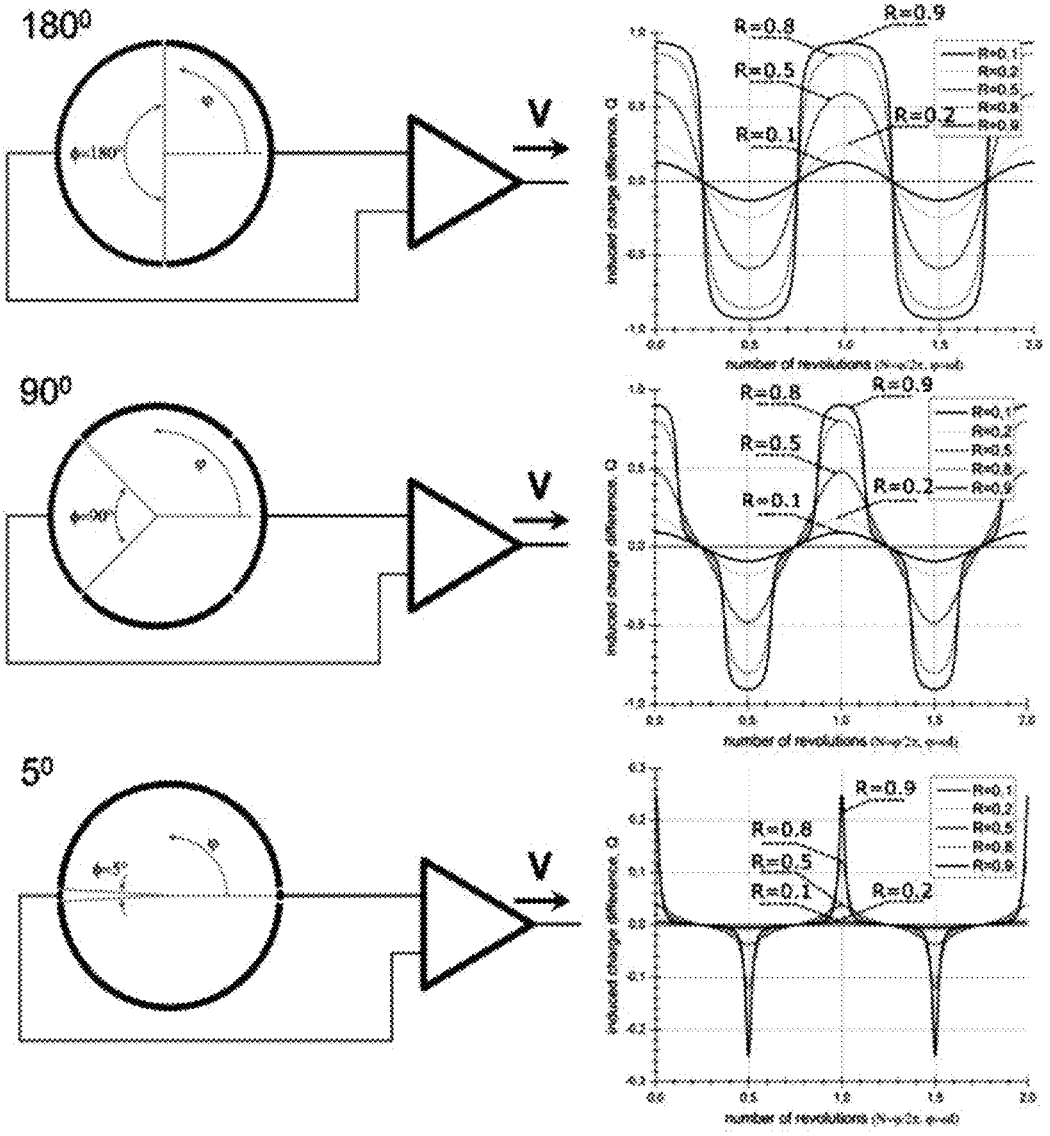
FIG. 1 shows induced time-domain signal generation in ion cyclotron resonance (ICR) mass spectrometry. (Top left) a modified version of the conventional ICR ion trap with wide detection electrodes. (Top right) the corresponding transient signal behavior as a function of ion rotation radii. (Middle left) a conventional ICR ion trap with 90° electrodes for excitation and detection. (Middle right) the corresponding transient signal behavior as a function of ion rotation radii. The transient signal's form is close to a sinusoidal function when ions rotate at ~0.5 trap radius. (Bottom left) a modified version of the ICR ion trap with narrow aperture detection electrodes (as suggested for use in the current invention). (Bottom right) the corresponding transient signals are substantially different from the 90° or wide detection electrodes, especially at high ion orbits (radii)

Fundamentally, invention is based on a new concept of ion motion and detection using directed, narrow aperture (flat), electrodes instead of wide, signal integrating, electrodes as employed in all current FT-ICR MS systems. FIG. 1 illustrates differences in detected ion signal shape as a function of detection electrodes configuration. Depending on the radius of ion orbit after excitation and during signal detection, transient components will change their shape starting from pure sinusoidal signals (as in standard ICR ion trap) at low orbits and ending in a limiting case of sharp functions, known as sha-function, at high orbits. Shown are two excitation and two detection electrodes in each configuration, whereas lower and higher number of either excitation or detection electrodes is possible. Standard ICR ion trap configuration herein and further in the text is referred to a cylindrical open ICR ion trap with a pair of 90° wide aperture detection electrodes and a similar pair of excitation electrodes.

Figure 3:
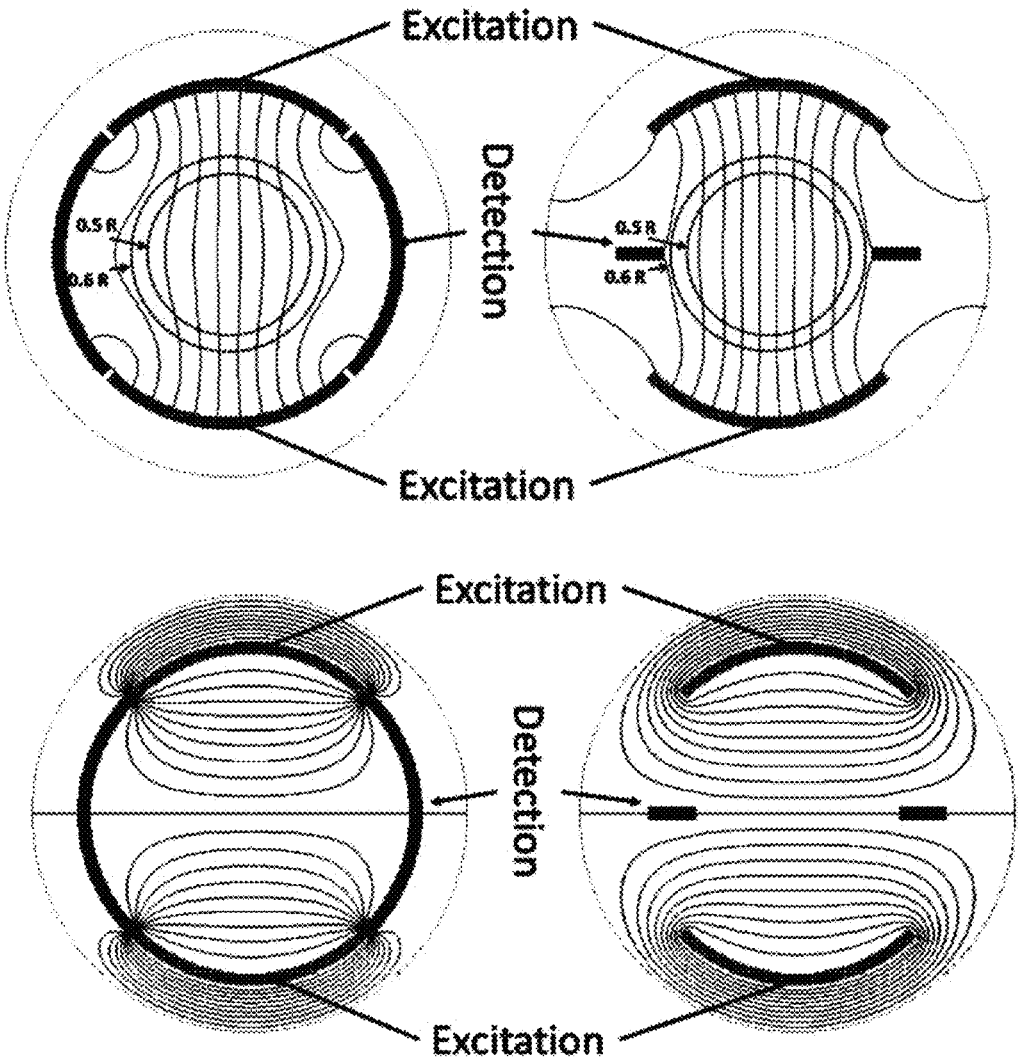
FIG. 3 shows the difference between the two ICR ion traps in the ion excitation conditions. SIMION-modeling of the ICR cells with narrow aperture curved detection and standard 90° excitation electrodes, as well as with standard 90° detection/excitation electrodes. (Top left) show the excitation field lines and (bottom left) potential distribution for a standard ICR cell. (Top right) show the excitation field lines and (bottom right) potential distribution for NADEL ICR cell with curved detection electrodes. RF excitation potential distribution with standard 90° excitation electrodes does not favor for excitation of a coherent ion cloud to the large radii. Narrow aperture detection electrodes in the zero-plane of the excitation RF field may improve coherent ion cloud excitation, as well as ion excitation to the large radii.
Figure 5:
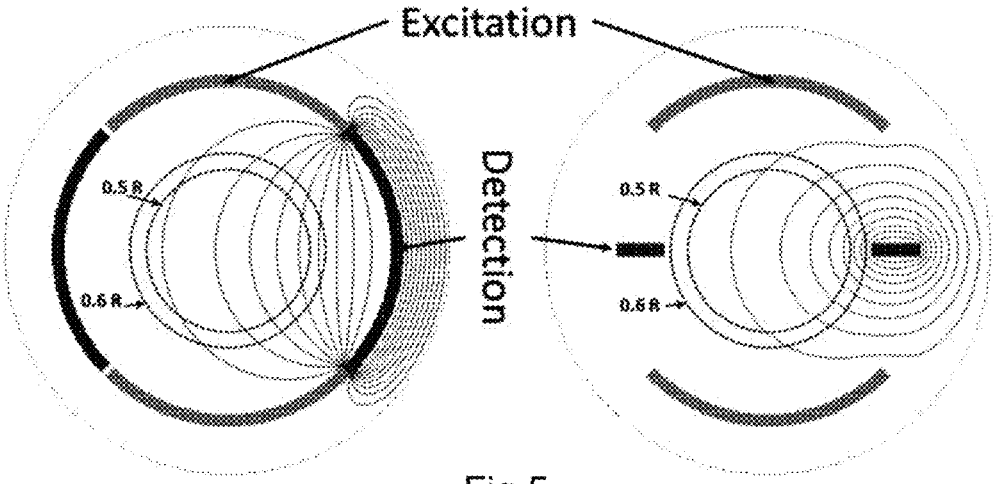
FIG. 5 shows the detection electrode potential distribution on the narrow aperture detection electrode, demonstrating non-linear increase of ion signal intensity when an ion approaches the detection electrode's edge. Similar potential distribution is valid for other narrow aperture detection electrodes. Shown is SIMION-modeling potential distribution of the ICR ion traps (left) with standard 90° detection/excitation electrodes and (right) with narrow aperture curved detection and standard 90° excitation electrodes. The employed parameters for simulation of detection electrode potential contours: detection electrodes sustained at 0 V and 1 V, all equipotential contours correspond to the range of 0.1 V to 0.9 V with 0.1 V increments.

When one pair of narrow aperture detection electrodes and one pair of wide aperture excitation electrodes are employed, the ICR ion trap configuration is shown in FIG. 2. Further in the text the narrow aperture detection electrode ICR ion trap will be referred to as NADEL ICR ion trap. Importantly, NADEL electrodes in a configuration shown in FIG. 2 are inserted radially inward allowing reduction in a distance between ions and the detection electrode surface. In turn, shortening of this distance increases the sensitivity of the measurements. The unrolled surface of the NADEL ICR ion trap shows the electrode connections and specifies their use. The surfaces of the NADEL electrodes are generally perpendicular to the unperturbed electric field lines. FIG. 3 further details the difference between the two ICR ion traps in the ion excitation conditions: standard and NADEL ICR ion traps. Ion RF excitation potential distribution with standard 90° excitation electrodes does not favor excitation of a coherent ion cloud to the large radii. NADEL electrodes in the zero-plane of the excitation RF field may improve coherent ion cloud excitation, as well as ion excitation to the large radii. The potential distribution of the trapping electric field in ICR ion traps with different configuration of detection electrodes is shown in FIG. 4. The curvature shape of detection electrodes is aimed to optimize trapping potential distribution and thus optimize ion trajectories in NADEL ICR ion traps upon ion trapping, excitation, and detection. The magnitude of electrode curvature is a function of ICR ion trap dimensions (for example, excite electrode length and ion trap diameter. For example, the radial boundary r(z) of each detection electrode as a function axial coordinate z can be approximated with the following formula:

$$r(z) = r_0 + R\left(1 - \sqrt{1 - \frac{z^2}{R^2}}\right)$$

where $r_0$ is the distance from the detector electrode edge to the ICR ion trap center (axis) at z=0 and R is the electrode's radius of curvature, for example R=125 mm. Detection electrodes can also be reduced in length for further optimization of trapping potential distribution. To demonstrate ion detection efficiency and behavior, detection potential distributions of NADEL and standard ICR ion traps are compared in FIG. 5. The presented detection potential distributions demonstrate a non-linear increase of ion signal intensity when an ion approaches the detector edge. Due to a substantially reduced size (surface) of NADEL electrodes comparted to standard 90° wide aperture detection electrodes, capacitance of the NADEL electrodes is reduced proportionally, leading to increased sensitivity of induced current measurements. Similar detection potential distribution is valid for other NADEL electrodes if they are present in a given ICR cell configuration. A particular benefit of a NADEL ICR cell shown in FIG. 2 is due to its large open surfaces at the cell sides. Such configuration may improve efficiency of spectroscopy techniques with detection of photons that enter or exit the ICR cell.

Figure 6:
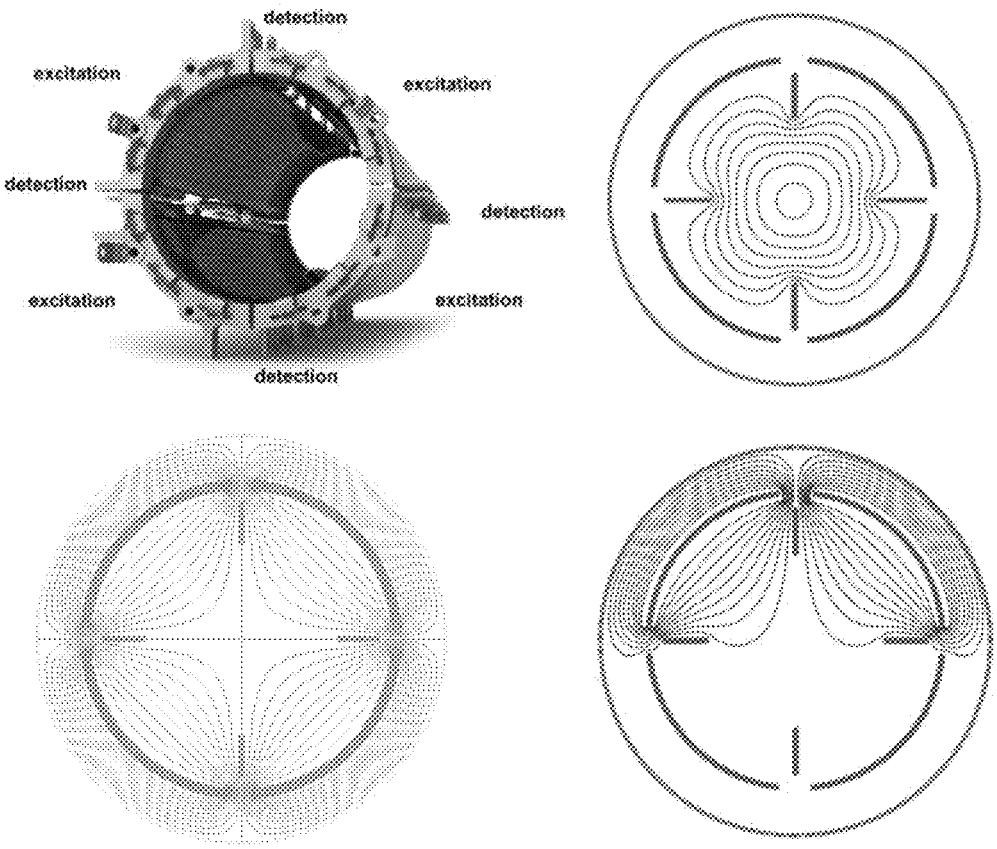
FIG. 6 shows a NADEL ICR ion trap with four electrodes that can be employed for ion excitation and four electrodes that can be employed for ion detection. (Top panel) shows (left) a 3D view and (right) trapping field distribution; (bottom panel) shows a potential distribution for (left) quadrupolar or quadrature ion excitation and (right) for adjacent electrode excitation. The envisioned use of this ICR trap is for either of quadrupolar, quadrature, and adjacent modes of ion excitation, as well as quadrupolar or dipolar ion detection.

Increasing the number of NADEL electrodes creates new capabilities for FT-ICR mass spectrometry. A NADEL ICR cell with symmetrically-distributed four NADEL electrodes and four wide aperture excitation electrodes is a particularly attractive configuration, FIG. 6. Such a configuration allows implementing efficient quadrupolar or quadrature ion excitation, when all four excitation electrodes are employed for ion excitation. In case of a quadrupolar ion excitation, phase shift between the adjacent excitation electrodes is 90°, whereas in a case of a quadrature excitation, phase shift between the adjacent excitation electrodes is 180°. Thus implemented quadrature and quadrupolar ion excitation may improve coherence of ion motion during and after excitation and allow more efficient excitation to larger orbits. A combination with regular dipolar excitation can also be employed, specifically when dipolar excitation is used to excite ions from the ICR cell axis to a small orbit and further excitation with quadrature/quadrupolar ion excitation. Finally, other approaches to ion excitations become possible, for example dipolar excitation on adjacent excitation electrodes (when the opposite pair of electrodes is grounded or is under a certain DC potential or subjected to a lower intensity RF excitation field). Similarly to NADEL ICR cell with only one pair of excitation and one pair of detection electrodes, improved excitation can be achieved when excitation field is extended beyond the excitation electrodes, for example when excitation electrodes are capacitively coupled. In addition to new capabilities of ion excitation, NADEL ICR cells with four excitation and four NADEL electrodes create new capabilities for ion detection. In addition to a standard dipolar ion excitation, ion motion can be detected when all four detection electrodes are employed together—in a form of a quadrupolar ion detection. The benefits from quadrupolar ion detection will be discussed below when unperturbed cyclotron frequency detection will be considered. Instead of a quadrupolar ion detection, a double frequency multiple can be recorded for twice increased resolution obtained in the same ion detection period (transient duration) as dipolar in detection in NADEL or standard ICR cell with a single pair of detection electrodes. Furthermore, if dipolar ion detection is employed, this ICR cell configuration offers an opportunity to record two transients at a time by independent ion detection on two pairs of detection electrodes. Doing so, the scan speed of an FT-ICR mass spectrometer doubles. Thus obtained transients can be summed up together leading to proportionally increased signal-to-noise ratio in frequency (mass) spectra. These transients can also be processed using other mathematical treatments, for example correlation, providing additional information on transients, e. g., phase.

Further increasing the number of NADEL and excitation electrodes may result in a configuration depicted in FIG. 7. Having eight NADEL and eight excitation electrodes creates a possibility for implementation of an octopolar ion excitation, which can be used independently or in combination with dipolar and/or quadrupolar/quadrature ion excitation. The use of octopolar ion excitation can further increase coherence of ion motion and thus lead to improved ion detection, especially when ion excitation to large orbits is employed. Having eight detection electrodes creates the following options: dipolar detection on four pairs of detection electrodes leading to simultaneous detection of four transients; quadrupolar detection on two sets of four electrodes, leading to simultaneous detection of two transients; detection on all eight electrodes leading to detection on a quadruple frequency multiple for correspondingly increased resolution per unit of detection time.

Further increase of a number of NADEL and/or excitation electrodes can be accomplished following similar logic of using NADEL electrodes for detection and wide aperture electrodes for ion excitation. However, due to increased number of electrodes, the aperture angle of excitation electrodes will reduce. Therefore, using narrow aperture excitation electrodes, with a shape that can be similar to NADEL electrodes, can be envisioned.

Figure 9:
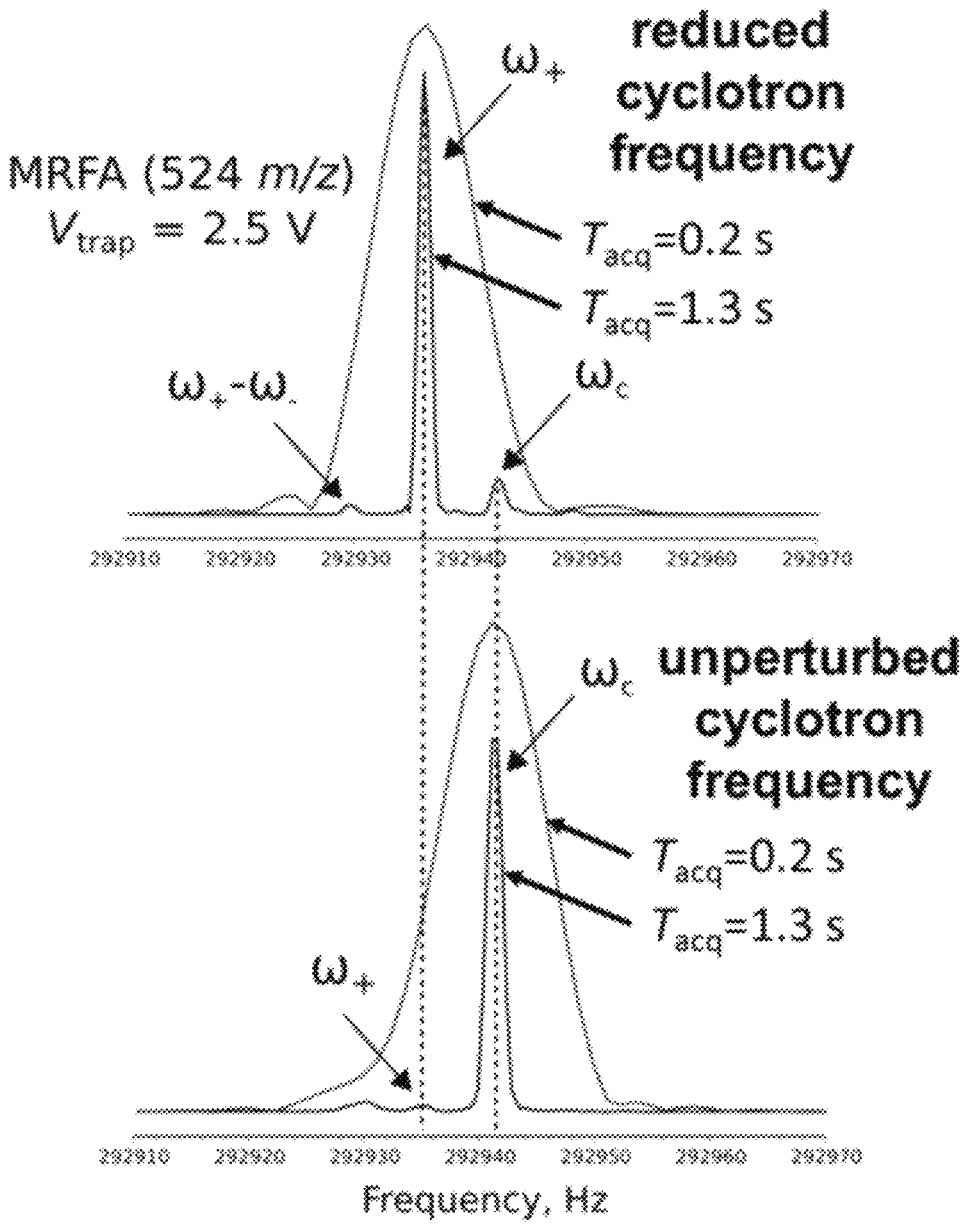
FIG. 9 shows ion peak structure when (top panel) reduced cyclotron frequency detection is realized and (bottom panel) unperturbed cyclotron frequency regime is realized. Peptide employed for this study is MRFA with its protonated monoisotopic ion at around m/z 524.
Figure 11:
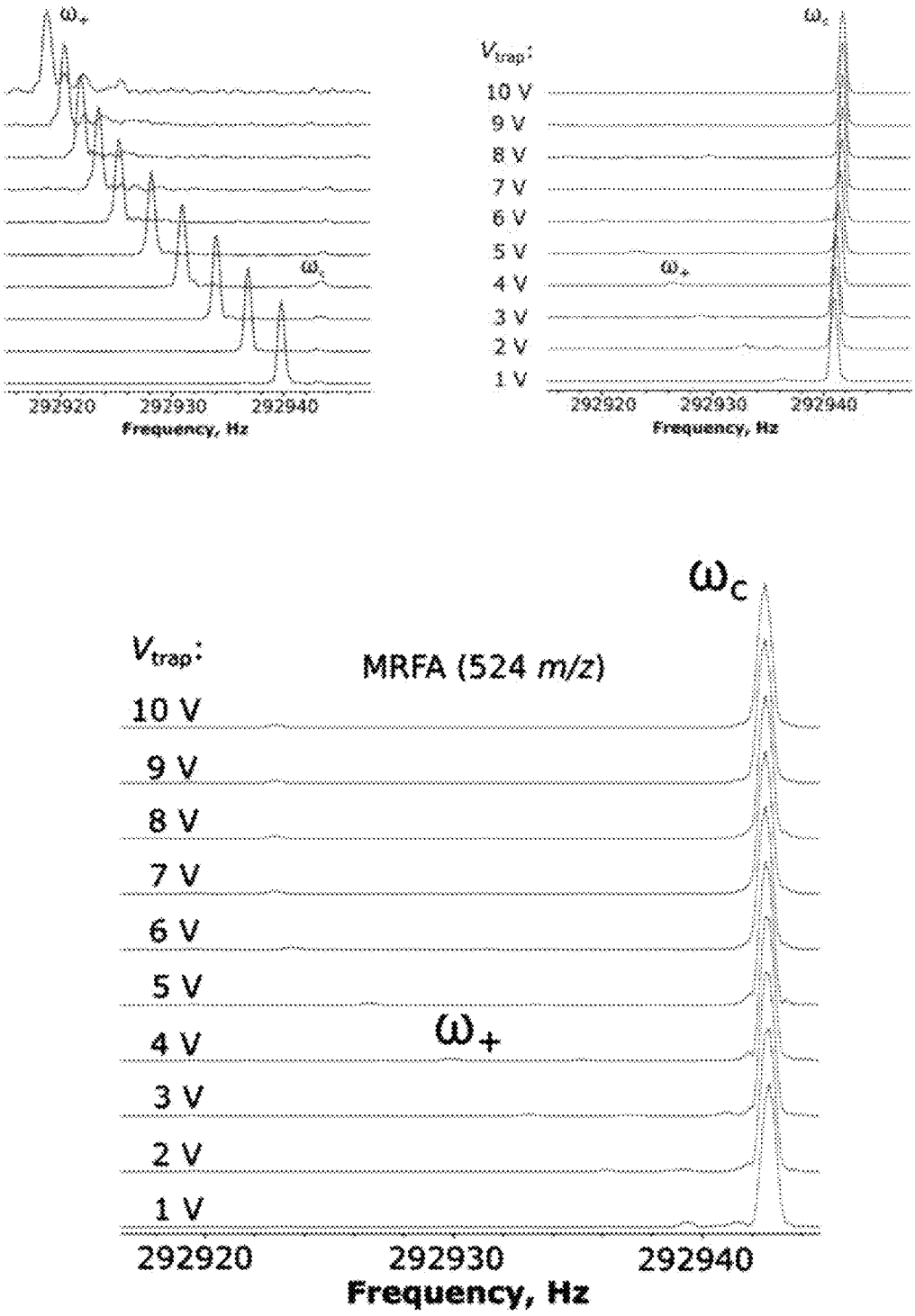
FIG. 11 shows the dependence of the reduced cyclotron frequency ω+ and the unperturbed cyclotron frequency $\omega_c$ on the trapping potential, applied during detection event, for corresponding optimal regimes: ω+—maximum (blue) and $\omega_c$—maximum (green). Results are shown for (top panel) NADLE ICR ion trap with one pair of detection electrodes (dipolar ion detection) and (bottom panel) with two pairs of detection electrodes (quadrupolar ion detection). Experimental results were obtained on a 10 T FT-ICR mass spectrometer with acquisition time 3.072 s, excitation amplitude EA=25 V and excitation duration $T_{exc}=20$ ms.

To address a disadvantage of a prior art in terms of reduced versus unperturbed cyclotron frequency detection, NADEL ICR cells offer this desired capability using one, two, or more pairs of NADEL electrodes. According to the current understanding of the underlying ion physics, this capability is due to specific distributions of electric fields, e.g., trapping field, in NADEL ICR cells, FIG. 8. Indeed, as was shown in FIG. 2, trapping potential distribution in NADEL ICR cell with a pair of detection electrodes is different from a standard ICR cell configuration. FIG. 8 shows how this difference can be further increased by application of DC offset potentials to the excitation electrodes. Thus formed trapping potential distributions are more of an elliptic configuration than circular. The aperture of excitation electrodes can vary in a large range, from 1° to 180°. FIG. 2 shows 90° excitation electrode configuration and FIG. 8 shows about 176° excitation electrode configuration. The aperture of excitation electrodes and their shape (cylindrical or flat) also influences the distribution of a trapping electric field. The resulting electric field, due to NADEL and excitation electrodes as well as to the offset potentials, causes ions to move on trajectories that differ from standard circular trajectories in standard ICR cells. As a result, even in a NADEL ICR cell with dipolar ion excitation and dipolar ion detection the detected frequency components in frequency (mass) spectra may correspond to the unperturbed cyclotron frequency values and not to the reduced cyclotron frequency upon certain parameters selection, FIG. 9. Trapping field configuration can be efficiently varied using offset potentials for both positive and negative ion detection, providing an opportunity to select detection of reduced or unperturbed ion cyclotron frequencies, FIG. 10. An important characteristic of unperturbed cyclotron frequency detection is its substantially reduced dependence on trapping electric field present in the ICR cell. FIG. 11 confirms the hypothesis that the observed peaks in frequency (mass) spectra correspond to the unperturbed cyclotron frequency by showing their relative independence on trapping potential. In turn, reduced cyclotron frequency shifts with a change in trapping potential, as expected. In FIG. 11 the top panel is an experimental result acquired with a NADEL ICR cell equipped with one pair of NADEL electrodes and a pair of 176° aperture excitation electrodes and the bottom panel is an experimental result acquired with a NADEL ICR cell equipped with two pairs of NADEL electrodes and two pairs of 90° aperture excitation electrodes. The former configuration employed dipolar ion excitation and dipolar ion detection, whereas the latter configuration employed adjacent electrode ion excitation and quadrupolar ion detection. Overall these results, shown in FIGS. 8-11, confirm a capability of NADEL ICR cell to provide ion detection at unperturbed cyclotron frequency in diverse cell configurations. Importantly, due to the thus introduced specific ion motion and ion detection, the overall dimensions of NADEL ICR cells can be efficiently reduced allowing implementation of smaller, for example of 10-20 mm external diameter, ICR cells for benchtop and mobile FT-ICR MS platforms.

Figure 12:
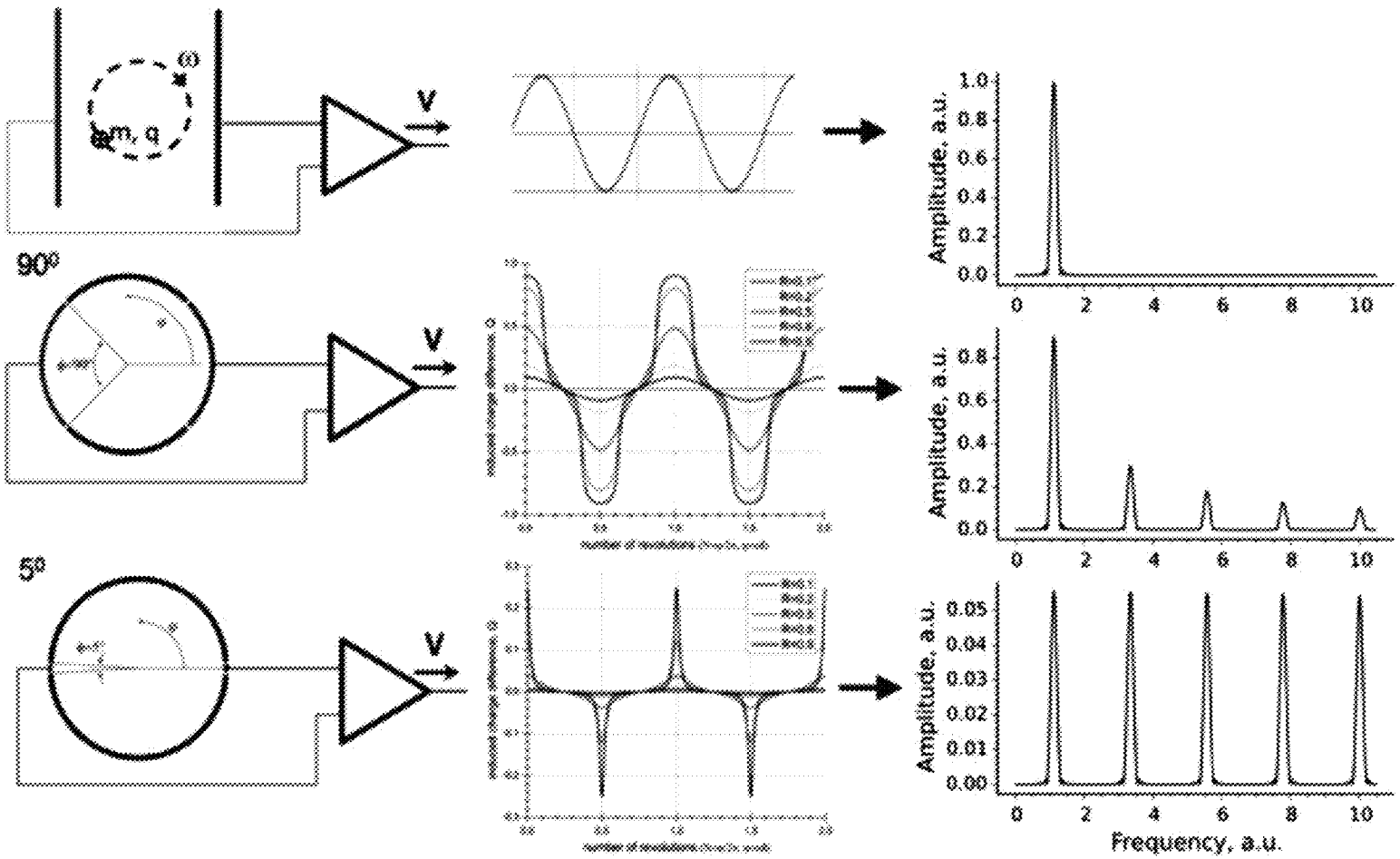
FIG. 12 shows mass spectra and corresponding induced time-domain signal generation in ion cyclotron resonance (ICR) mass spectrometry. (Top left) two infinitely extended parallel flat electrodes, (middle left) conventional ICR ion trap with 90° electrodes for excitation and detection and (bottom left) an ICR ion trap with highly directional detection electrodes. (Top-bottom middle) the corresponding transient signal behavior as a function of ion rotation radii and (top-bottom right) the corresponding mass spectra.
Figure 13:
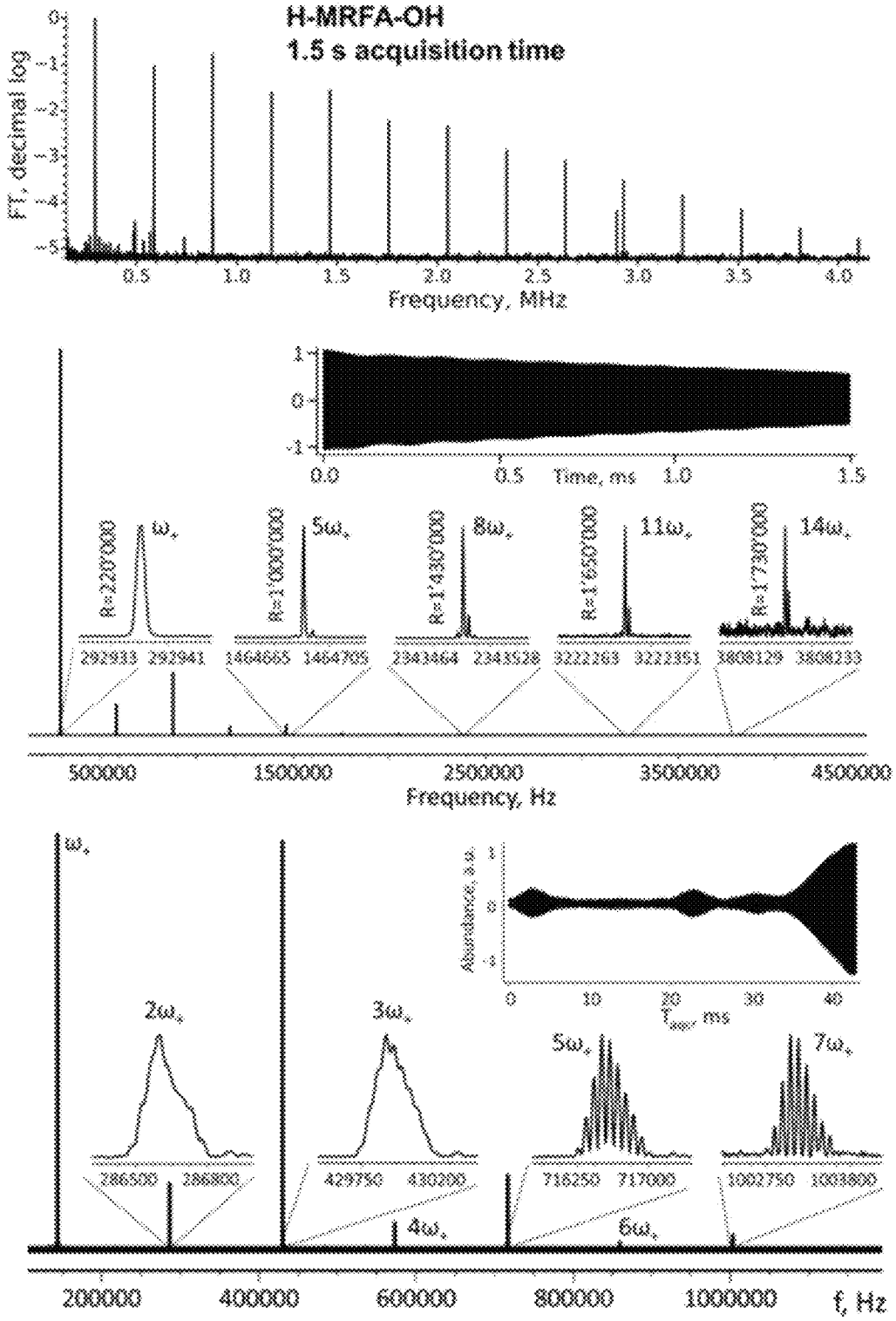
FIG. 13 shows mass spectra acquired with ion excitation to high radii (many harmonics content, broadband ion detection) on a 10 T FT-ICR mass spectrometer. (Top panel) shows a mass spectrum (y-axis in decimal log) obtained from sum of 500 single scans with acquisition time 1.536 s acquired with isolated singly protonated ions of MRFA 524.2 m/z. (Middle panel) shows expanded views of peaks corresponding to the diverse harmonics of selected ion from the mass spectrum of the isolated singly protonated ions of MRFA 524.2 m/z. (Bottom panel) shows a mass spectrum of the isolated ubiquitin bovine 8+ charge state, at 1071 m/z. Insets show expanded views of isotopic distributions corresponding to the diverse harmonics of selected ions and demonstrate resolved isotopic distribution of protein for fifth harmonic with acquisition time 43 ms.
Figure 14:
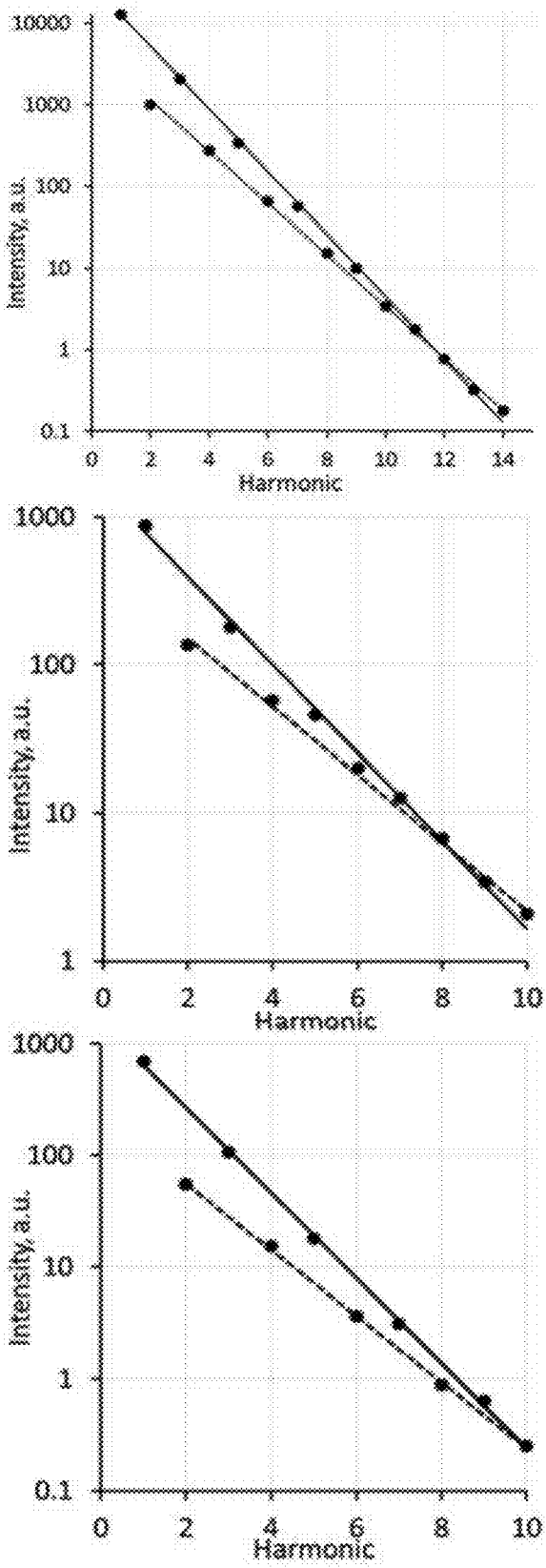
FIG. 14 shows the signal-to-noise ratio for diverse harmonics (see FIG. 13) obtained for (top panel) isolated singly protonated ions of MRFA 524.2 m/z with acquisition time 1.536 s; (middle panel) for isolated singly protonated ions of substance P 1347 m/z with acquisition time 8 ms and (bottom panel) for isolated ions of 8+ charge state of ubiquitin bovine 1071 m/z with acquisition time 43 ms.

To address another disadvantage of prior art mentioned above, namely limited resolution increase per increment of data acquisition time, NADEL ICR cells offer a capability to record transients that contain sharp signals instead of purely sinusoidal ones, FIG. 1 and FIG. 12. Recording such signals is enhanced by increasing the orbit of ion rotation in an ICR cell. Fourier transformation of thus acquired transients leads to appearance of high order harmonics in frequency (mass) spectra, as schematically shown in FIG. 12. Experimental validation of this hypothesis is presented in FIG. 13 for peptide and protein ions of biological interest. Obviously, higher order harmonics provide increased resolution. Despite the fact that the acquisition time is the same for all harmonics shown, it is possible to resolve the isotopic envelopes of peptide and protein samples even if they are unresolved at the fundamental frequency (first harmonic). These measurements confirm the fact that ion motion in NADEL ICR cell is more coherent than used by standard Fourier transform and thus increased resolution per unit of time can be obtained with directional ion detection using NADEL ICR cell configuration. Importantly, analysis of diverse samples indicates that the ratio of signal-to-noise values for even and odd harmonics follow a certain reproducible dependence, depicted in FIG. 14. This information is a key toward a development of a corresponding algorithm for signal processing of transients with sharp components. Indeed, signal generation with periodic non-sinusoidal components encodes increased resolution of periodic motion of ion clouds. Therefore, having information on harmonics distribution as shown in FIG. 14, we thus introduce here a method dedicated for analysis of transients that otherwise provide many harmonics components if processed with standard Fourier transform (FT). The introduced here method is called "extended basis FT", or "xFT" and is schematically depicted in FIG. 15. The method uses an extended basis of complex exponents describing the mass analyzer's amplitude-phase response as a function of the frequency order. Following an optional apodization procedure, transients of interest are transformed into the frequency domain by FT running on the extended basis. Information on ion phases can be further included into a consideration to provide an absorption mode-type spectral representation for xFT instead of a magnitude mode, similarly to the magnitude and absorption mode of a standard FT method. The benefits from xFT method application to transients with sharp functions is that this method may provide an increased resolution (FIG. 15 top panel) or remove unwanted harmonics from frequency (mass) spectra (FIG. 15 bottom panel). Furthermore, xFT can be applied to other transients that contain non-sinusoidal components, acquired not only with NADEL ICR mass spectrometry, but also with other types of mass analyzers, for example electrostatic field-based ion traps (Orbitrap and electrostatic linear ion trap), or RF electric field based (Paul ion trap or a linear ion trap-based). The computation cost of the xFT algorithm benefits from using parallel fast FT for a major part of processing. Specifically, the computation time scales approximately as (l/p)O(N log N)+B, where N is the number of points in a transient, p is the number of processors employed, and B is an overhead from non-parallelizable operations.

Figure 16:
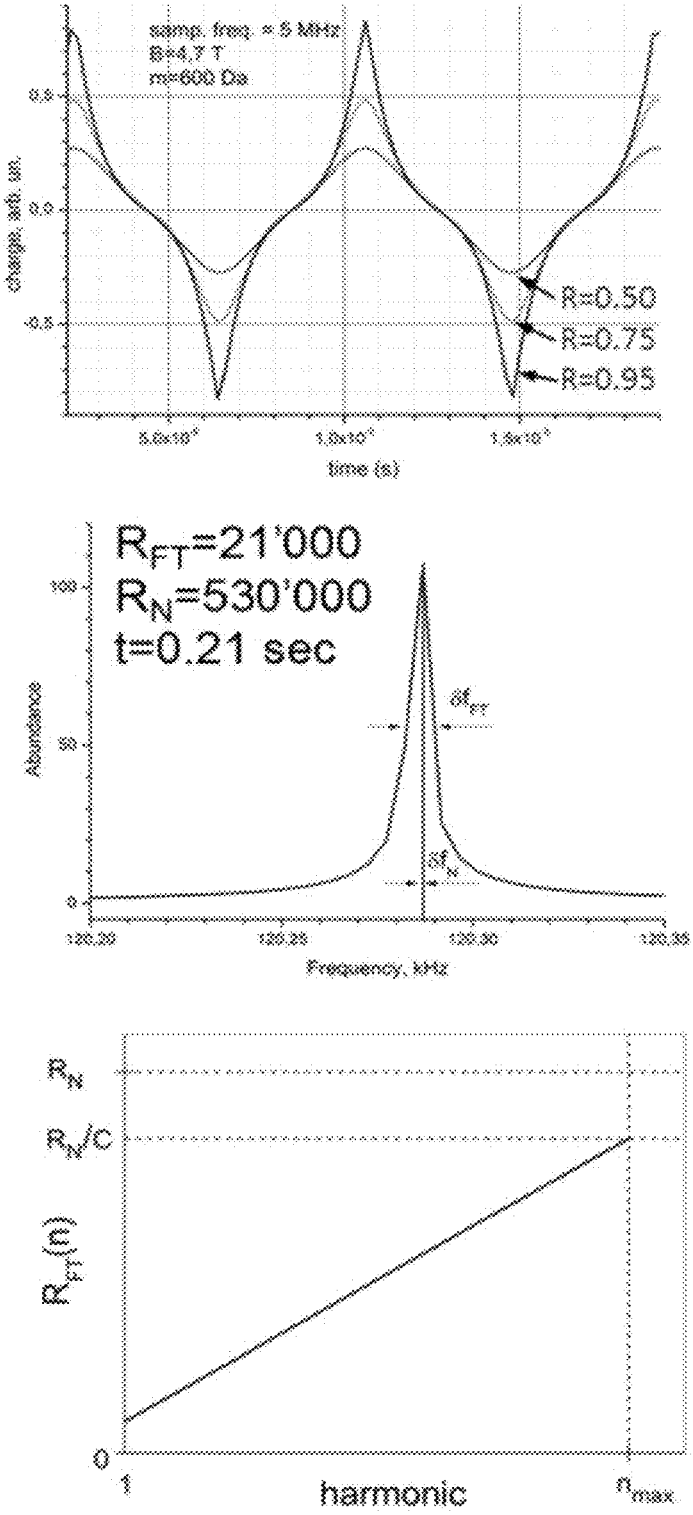
FIG. 16 shows (top panel) a period of a time-domain transient signal generated by 600 m/z ion rotating at orbits of different radii in magnetic field of 4.7 T of an ICR ion trap with narrow aperture detection electrodes (SIMION data). (Middle panel) Signal digitization of 5 MHz limits maximum resolving power that could be obtained by pattern recognition. Nevertheless, signal processing with pattern recognition gives 530 k resolving power in 0.21 s of transient duration, compared to 21 k resolving power obtained by FT of the same transient. (Bottom panel) resolving power from the FT signal processing can be further increased by considering the many harmonics generated. Maximum resolving power obtained by FT almost reaches the pattern recognition-produced resolving power.
Figure 17:
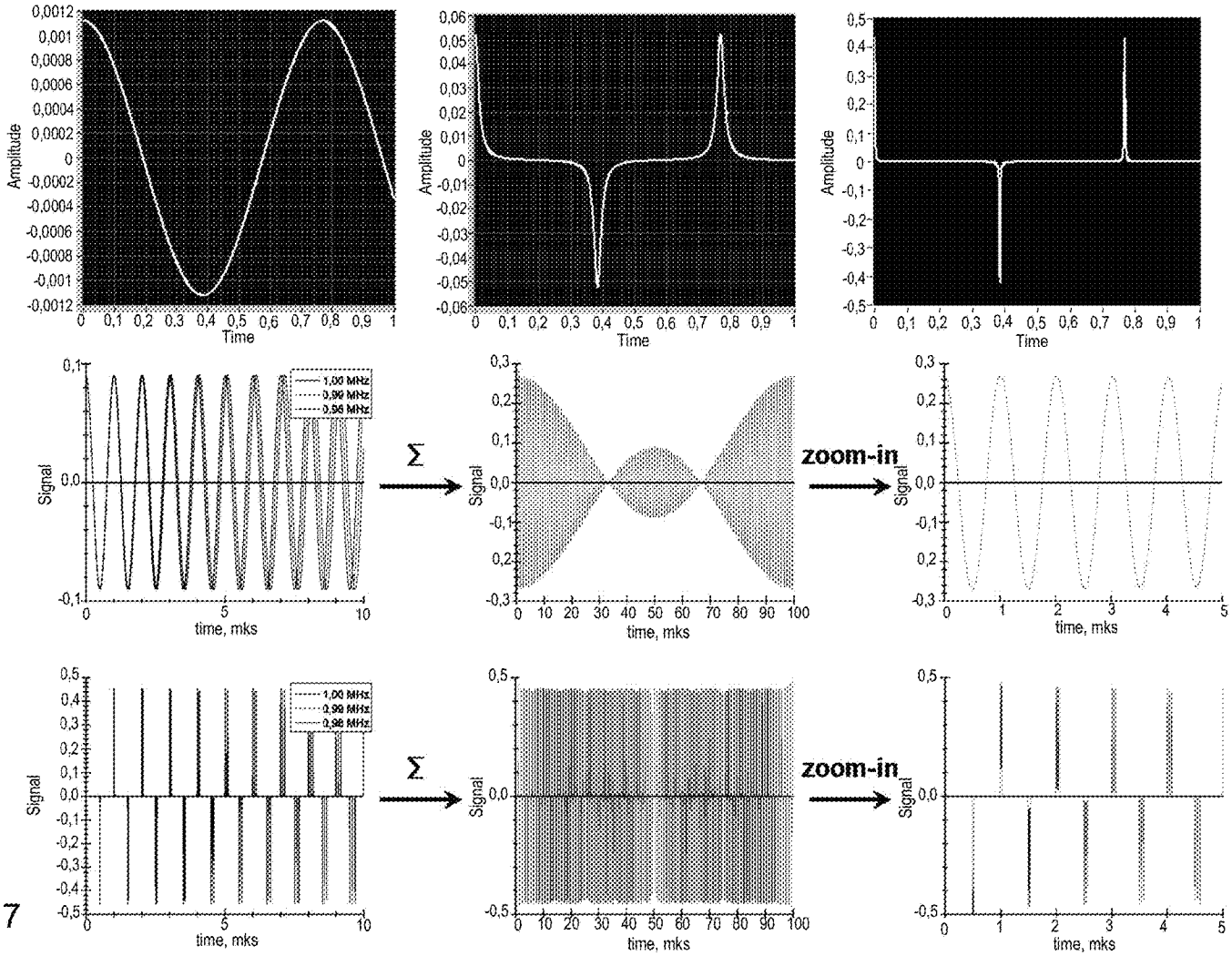
FIG. 17 shows time-domain transient signals from ion clouds, including (top panel) expanded segments of transient signal obtained with (top left) standard FT-ICR mass spectrometry with 90° detection electrodes; (top center) ICR mass spectrometry with narrow aperture detection electrodes with large distance between electrodes and ion cloud, and (top right) ICR mass spectrometry with narrow aperture detection electrodes with small distance between electrodes and ion cloud. In all cases, a single ion with m/z 524 is considered in magnetic field of 10 T. The resulting transient signals are shown as (middle panel) conventional and (bottom panel) suggested by the current invention ICR ion trap mass spectrometry. The middle panel transient is typically treated with FT methods, whereas the bottom panel transient is to be considered not only by the FT methods, but also the alternative methods, e.g., super-resolution signal processing methods, such as filter diagonalization method (FDM) and least-squares fitting (LSF), as well as extended basis FT.
Figure 18B:
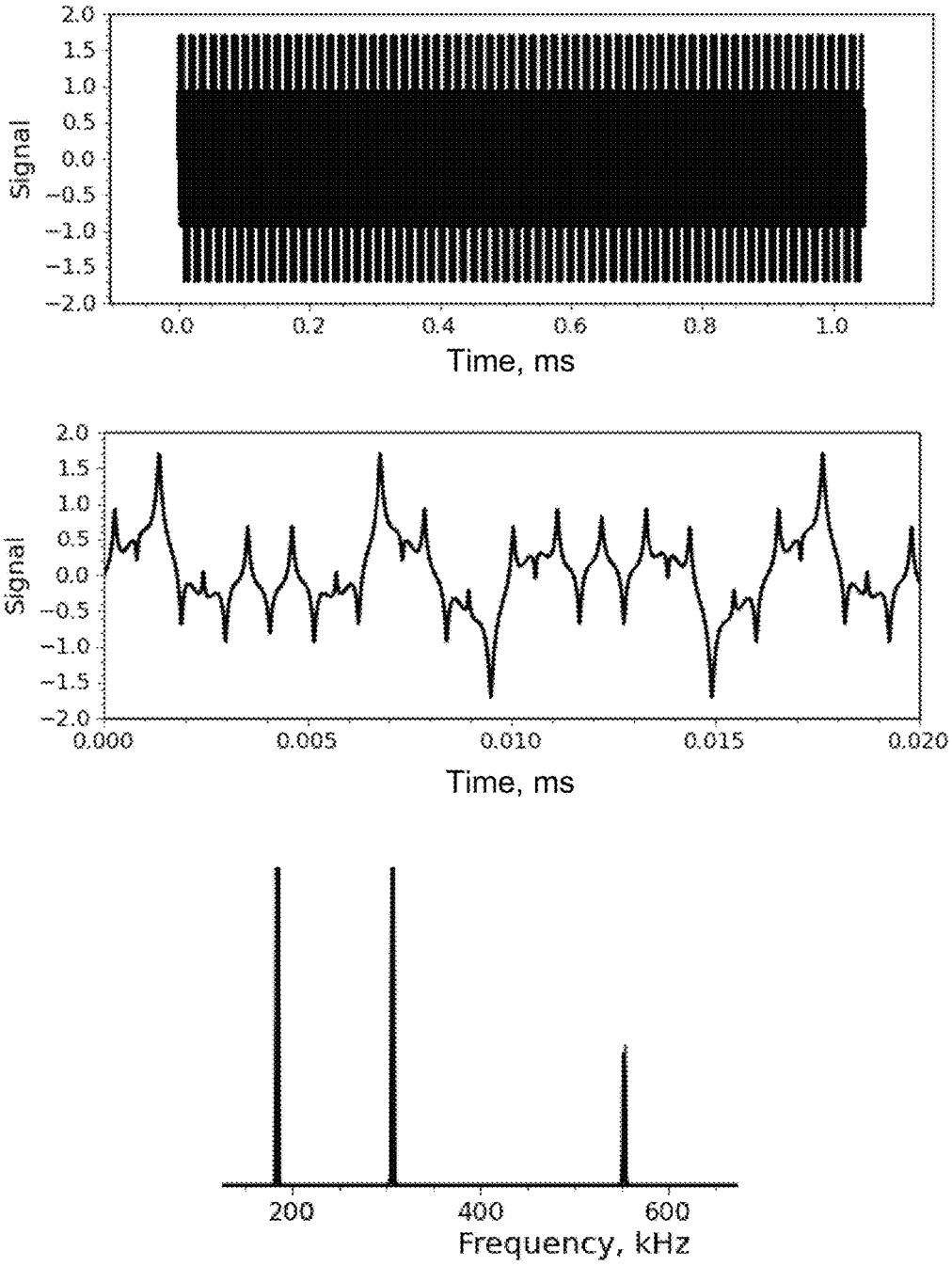
Figure 19:
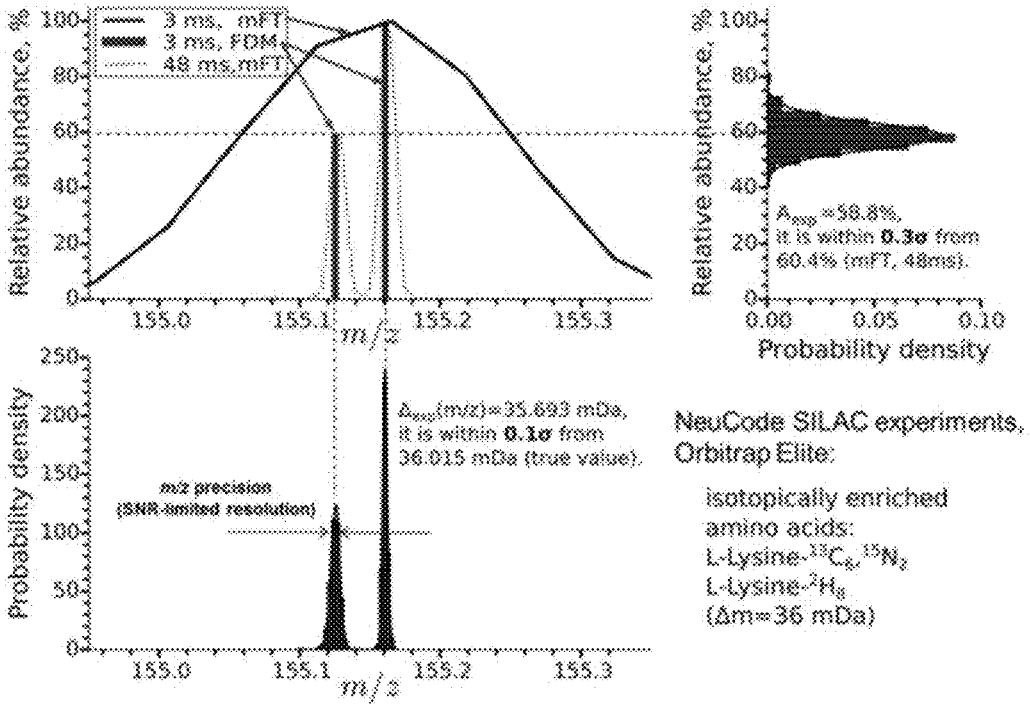
FIG. 19 shows experimental induced current-recorded mass spectra of a pair of isobaric molecules generated by transient signal processing with FT and filter-diagonalization method (FDM). FDM results are obtained with error estimates for both m/z and abundance values. Resolution in FDM is governed not only by transient duration but also by the signal-to-noise ratio of a given peak. FDM allows substantial increase in resolution compared to FT for the same transient signal duration when sufficient SNR values for the peaks of interest are available. When applied to the transients as shown in FIG. 18, FDM basis set is to be extended, similarly to the extended basis Fourier transform method described in FIG. 15.

The maximum possible resolution achievable from processing of transients with sharp features is a function of the transient components shape, where sha-function is the limiting case, FIG. 16 and FIG. 17. Clearly, very sharp transient components allow for much faster separation of spectral components compared to the standard pure sinusoidal components. Maximum resolving power potentially obtained by FT of the highest possible harmonics component almost reaches the pattern recognition-produced resolving power. Improved performance of the xFT methods comes with the use of super-resolution methods of signal processing, e.g., least-squares fitting (LSF) or filter diagonalization method (FDM) for transient processing. These methods can be used as supporting methods to provide information for xFT processing, for example initial phases of transient components, or as stand-alone methods for processing of transients with pure sinusoidal or non-sinusoidal components, FIG. 18. The use of super-resolution methods, LSF and FDM, differs from the FT application particularly due to the fact that LSF and FDM are parameter estimators, whereas FT (and xFT) is a spectral estimator. Therefore, to accurately determine the position of a peak on a frequency or m/z scale, as well as its abundance, LSF and FDM are to be performed multiple times with variation of seed parameters and basis functions to provide statistically valid distributions serving as errors estimates. When transients with sharp non-sinusoidal components are considered, the basis functions of LSF and FDM are to be modified in a similar way as performed for extended basis FT, or xFT. By doing so, the extended basis LSF and/or FDM can surpass resolution performance of xFT.

Overall, herein presented methods of signal processing, including xFT, LSF and FDM, complement magnitude and absorption mode FT to deliver the best possible result when transient components are non-sinusoidal. Importantly, super-resolution signal processing methods validate the use of NADEL electrodes for ion manipulation and detection in FT-ICR MS. These methods demonstrate the fact that ion coherence in FT-ICR MS exceeds performance of FT-based methods. Therefore, taken together, ion physics of NADEL electrodes configuration and improved algorithms of signal processing allow addressing the disadvantages of the prior art as described in this invention description.

Particularly Favorable Embodiments

The present invention has several particularly favorable embodiments, including the following:

1. Enhanced ion excitation conditions, specifically with dipolar ion excitation, due to improved configuration of excitation electric field. The latter is achieved by reduced excite field disturbance by radially inserted detection electrodes compared to the standard 90° wide detection electrodes.
2. Simultaneous detection of a number of transients or detection at frequency multiples when several narrow aperture detection electrodes or electrode pairs are employed. This capability increases the sensitivity of the analysis by averaging of more transients acquired in the same experimental time.
3. Enabling implementation of efficient quadrature or quadrupolar ion excitation and quadrupolar ion detection schemes when two pairs of 90° wide excite electrodes and two narrow aperture detection electrode pairs are employed without the need for a high-frequency switch between excitation and detection modes.
4. Enabling implementation of efficient octopolar ion excitation when 8 (eight) excitation electrodes are employed.
5. Enabling combination of dipolar with quadrupolar or octopolar ion excitation in sequential order. For example, initial ion excitation can be performed with dipolar excitation. Once ions are excited to small orbits, quadrupolar or octopolar excitation is applied to improve coherence of ion motion.
6. Enabling acquisition of extended length transients by additional ion excitation using quadrupolar or octopolar ion excitation during ion detection or within the pauses of ion detection. That way very long transients can be obtained to provide increased resolution and/or sensitivity.
7. Suggested ICR ion traps are equipped with the highly directional narrow aperture detection electrodes or the antennae for improved ion optics and induced current generation. Time-domain signals can be acquired with miniaturized detectors (for example about 1 mm thin) and ion excitation to high orbits where ion-electrode distance is comparable to the detection electrode dimension—without substantial loss of induced charge amount.
8. The increase of induced current detection sensitivity is achieved by substantial reduction of the detection electrode capacitance through its miniaturization and an optional on-electrode, in-vacuum pre-amplifier placement. To reduce the distance between the excited ion orbits and the detector electrodes, these electrodes may be inserted radially into the ICR ion trap toward its center in the planes with minimum disturbance to the excite RF field.
9. Improving phase coherence of the accelerated ion cloud by the reduced influence of the properly positioned (in the planes providing minimum disturbance of the RF field strength) narrow aperture detection electrodes on the excitation RF field compared to the 90° electrodes.
10. The narrow aperture detection electrodes are shaped such that the trapping electric field is extended further toward the center of the ICR ion trap. They also aim to minimize the radial component of the trapping electric field.
11. With the use of narrow aperture detection electrodes, the number of excitation electrodes can be increased while keeping the wide aperture size of the excitation electrodes. Specifically, four excitation electrodes of about 90° each can be employed for improved ion excitation using the quadrupolar or quadrature ion excitation scheme. This method is important to improve the coherence and efficiency of ion excitation.

12. The number of narrow aperture detection electrodes can be increased. For example, four narrow aperture detection electrodes can be used together with quadrupolar ion excitation on four wide aperture excitation electrodes. Therefore, frequency multiples can be recorded using four and more of the narrow aperture detection electrodes. This method is favorable for increasing resolving power obtained in a given unit of time.
13. Variation of the excited ion radius shapes the function of ion induced current in the time-domain ion signal (transient). Increasing ion radius leads to sharper sinusoidal signals (with a limiting case of sha-function). The latter implies an increase in high order harmonics in frequency spectra. This method is favorable for increasing resolving power obtained in a given unit of time.
14. The latter regime requires the development of the matching signal processing methods, capable of efficient analysis of transients with high order harmonics components. Here we describe such methods of signal processing that use the physical properties of ion motion and detection ion ICR ion traps with narrow aperture detection electrodes. These signal processing methods aim to either increase the peak resolution in frequency (mass) spectra or to remove the unwanted harmonics from frequency (mass) spectra. Specifically, the following methods that employ extended basis sets to account for high order harmonics are suggested for use with ICR ion traps with narrow aperture detection electrodes: (i) extended Fourier transform basis method; (ii) filter diagonalization method with frequency and abundance errors estimate and extended basis set; and (iii) least-squares fitting of time-domain (transient) data with extended basis set
15. Particular distribution of electric fields in ICR ion trap with narrow aperture detection electrode or electrodes allows for generation of mass spectra with the main peaks corresponding to the unperturbed (true) cyclotron frequency, and not the typically recorded reduced (shifted by the magnetron frequency) cyclotron frequency. This method is favorable for improving analytical characteristics of ICR mass spectrometry, including mass accuracy and dynamic range (signal-to-noise ratio of components). Furthermore, recording ion signals at unperturbed cyclotron frequency implies its independence on the amplitude of the applied trapping electric field. Mass measurements performed at high trapping fields, for example 1-10 V, are particularly favorable for increased S/N in long transients (required for achieving high resolving power), as well as for product ion analysis from ion dissociation reactions performed in the volume of the ICR ion trap, for example as realized in ion-electron interactions, e.g., electron capture dissociation (ECD) and electron impact induced dissociation (EIID) of biomolecular ions.
16. Particular electric field distributions and ion trajectories in ICR ion traps with narrow aperture detection electrodes allow for efficient reduction of ion trap size (diameter), which in turn makes such reduced size ion traps attractive for application in FT-ICR mass spectrometers with reduced size magnets—for benchtop and mobile applications.
17. Facilitating and improving the efficiency of fluorescence-based ion spectroscopy due to substantially increased optical access to and from the ICR cell with narrow aperture detection electrodes

SPECIFIC PREFERRED EMBODIMENT

In a specific preferred embodiment, the invention further relates to Fourier transform mass spectrometry and, more particularly, to improving resolving power in electrostatic ion trap-based, for example in Orbitrap, Fourier transform mass spectrometry.

PRIOR ART TO SPECIFIC PREFERRED EMBODIMENT

Mass spectrometry (MS) is one of the most sensitive and selective analytical techniques for molecular structural and quantitative analysis. To provide molecular level information on samples from solid, liquid, or gas phase state, it is required to first transform molecules into charged particles (ions), then to separate the formed ions by their mass-to-charge ratios, m/z, and finally record the abundance of each species as a function of m/z values. The main analytical characteristics of mass spectrometric techniques include resolving power (or resolution), mass accuracy, dynamic range, and acquisition speed (throughput). Resolving power, or resolution, refers to an ability of a mass spectrometer to distinguish molecular species that are close in their m/z values. High resolving powers are needed to analyze complex molecular mixtures and to provide the required level of mass measurement accuracy. The complex molecular mixtures here also means analysis of isotopic fine structures of biomolecules, specifically peptides and proteins, as well as analysis of isotopic distribution of large biomolecules, e.g., proteins. A comprehensive analysis of crude oil and its fractions requires some of the most outstanding analytical characteristics of a mass spectrometer. Modern mass spectrometry has already revolutionized the way we consider molecular structural analysis nowadays, but the extreme sample complexity in many cases still cannot be addressed even by the most sophisticated instruments. The major application areas of MS nowadays are in life, pharmaceutical, clinical, environmental, material, and forensic sciences.

Fourier transform mass spectrometry (FTMS) is the leading mass spectrometric technology in terms of achievable resolving power and mass accuracy. The power of FTMS is in its ability to non-destructively (using induced current detection principle) record the frequency of a periodic ion motion over long, up to minutes, periods of time. Thus measured time-domain signals (transients) of image charge intensity are typically comprised of sinusoidal components. Each of these components is characterized by an amplitude, frequency, phase, and decay rate. Transients can be converted into the frequency spectra using Fourier transformation (FT) or other methods of signal processing, e.g., filter-diagonalization method (FDM) or least-squares fitting (LSF). The known relations of periodic ion motion frequency and m/z values allow converting frequency spectra into mass spectra. Calibration of mass spectra using known compounds provides accurate mass measurements. Low-ppm and sub-ppm mass accuracy levels are readily achievable nowadays for analysis of even the most complex mixtures. The resolving power of FTMS is directly proportional to the transient duration. The two main FTMS instruments nowadays are Fourier transform ion cyclotron resonance mass spectrometer (FT-ICR MS) and an Orbitrap FTMS. The former one employs static magnetic field for periodic ion motion development, whereas the latter one is electrostatic field based mass analyzer.

In Orbitrap FTMS, ions are generated externally to the orbitrap mass analyzer and are transferred to the orbitrap mass analyzer by pulsed injection of well confined ion packets. The most commonly employed ionization technique is electrospray ionization (ESI), which produces multiply charged molecular species. Once ions are transferred into the orbitrap mass analyzer, ion excitation by injection takes place and ions get trapped into the rings of ions periodically oscillating along a central spindle electrode. The specific shape of static electric field created between the spindle and detection electrodes allows for prolonged, up to several seconds, coherent motion of ion rings. The frequency of ion axial oscillations is related to the m/z values of the ions. By design, Orbitrap FTMS has an elegant feature that in the first-order theoretical approximation there exists the point of phase coherence. The practical aspect of the phase coherence point is that it permitted the implementation of the absorption-mode spectral representation in Orbitrap FTMS. A curious problem of the visual representation of the phase coherence point may be addressed using the LSF calculations of the ion phases and taking advantage of the restricted variation of the phase function throughout the broad frequency range at the phase coherence time moment. The use of FT absorption mode spectral representation, known as enhanced FT, or eFT, in Orbitrap FTMS, is extremely beneficial for Orbitrap FTMS applications, as it allows reducing the required transient duration twice without a loss in obtained resolving power. The use of eFT algorithm is particularly favorable for applications in life sciences, where experiments are performed with tight time constraints due to the use of sophisticated on-line liquid-phase separation techniques.

Overview articles on Orbitrap Fourier transform mass spectrometry are, for example: Scigelova, M.; Hornshaw, M.; Giannakopulos, A.; Makarov, A.: Fourier transform mass spectrometry. Molecular & Cellular Proteomics 2011, 10, M111.009431; Zubarev, R. A.; Makarov, A. Orbitrap mass spectrometry. Analytical Chemistry 2013, 85, 5288-5296.

DISCUSSION OF THE PRIOR ART

The inherent limitation of FTMS is the compromise between speed (throughput) and achieved resolving power. Acquiring data faster is required for improved analytical and technical characteristics of FTMS. Presently, absorption mode Fourier transform of transients in electrostatic ion trap-based FTMS is the state-of-the-art in achieving a maximum resolving power from a given length transient. Fundamentally, the implementation of absorption mode FT spectral representation on electrostatic trap FTMS does not require high level of accuracy in determination of initial phases for transient components. Therefore, the conventionally employed data acquisition systems with low to moderate sampling frequencies (typically 1 . . . 10 MHz, and maximum up to 40 MHz) are found to be sufficient for efficient absorption mode FT signal processing. Specifically, that is the case with Orbitrap FTMS, where the so-called enhanced FT algorithm is employed to deliver absorption mode-like FT spectral representation. However, the prior art specifies the absorption mode FT spectral representation as the absolute maximum in achievable resolving power from a transient of a given length. Overcoming this limitation is particularly useful for life science applications of mass spectrometry.

OBJECTIVE OF THE SPECIFIC PREFERRED EMBODIMENT

The specific preferred embodiment in particular aims at increasing the performance of mass spectrometry by increasing the resolving power in electrostatic ion trap-based Fourier transform mass spectrometry, for example in Orbitrap FTMS. The advancement is achieved by a combination of high performance data acquisition system allowing accurately determining initial phase information for spectral components and the tailored signal processing algorithm of a double phase correction, detailed here.

FIGS. 20-25

Figure 20:
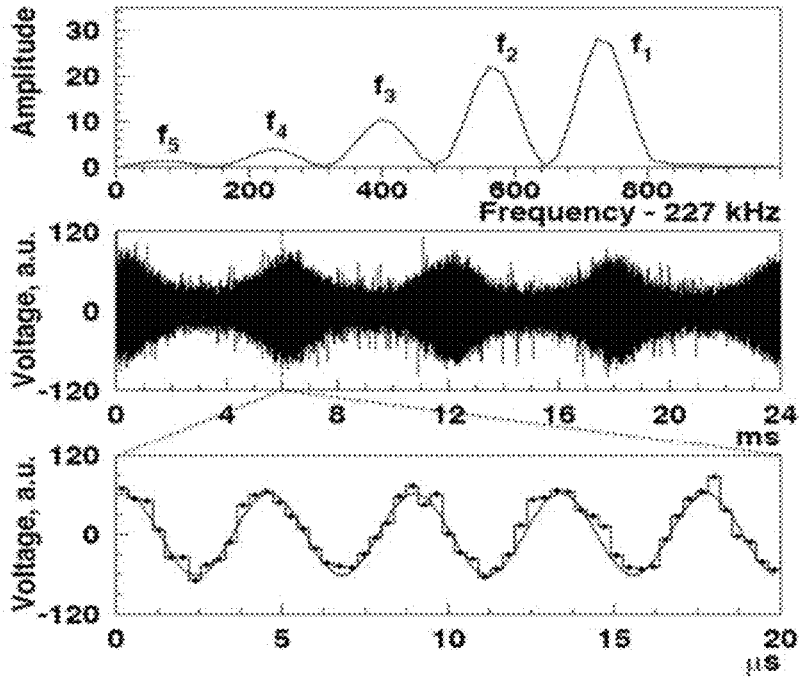
FIG. 20 shows a typical transient signal in Fourier transform mass spectrometry (FTMS)

FIG. 20 shows a typical transient signal in FTMS. One aim of signal processing is to decipher the components of these transient signals by assigning to each harmonic component contained there their characteristics: amplitude, frequency, initial phase, and decay. For example, least-squares fitting can be employed to decipher transients by fitting sinusoidal signals into the transients, as shown here in the bottom panel.

FIG. 21 Those FT mass analyzers that implement ion excitation by means of ion injection, e.g. the orbitrap, have an inherent feature that the initial phases of trapped ions are a linear function of their frequencies, neglecting higher-order deviations due to instrumental limitations. Due to ion excitation by ion injection, there exists a phase intersection point of the ions, i.e., a time point at which the total phases of ions intersect. This Figure illustrates the phase coherence point for ultramark calibrants analyzed with an FTMS instrument: a representative mass spectrum from a set of scans (panel A), determination of the phase coherence time moment (panel B), low-spread phase coherence point (panel C), and from-scan-to-scan reproducibility (panel D). Transient signals were acquired at high sampling frequency, 100 MHz, to make the influence of the analog (anti-aliasing) filter on the phase intersection point negligible and thus accurately locate the point of phase intersection, panel C. The initial phases of ions were calculated using LSF processing. The transients were FIR filtered and decimated down to the sampling frequency of 2 MHz. The phase intersection point was found using the least-squares solution of a system of linear phase equations written for each of the calibrants, taking into account linear phase shift due to FIR filtering. The constant (uncorrected) phase shift of approximately 227 degrees corresponds to the actual phase of zero at the point of phase intersection.

FIG. 22 shows the results of the application of the method of double phase correction described here to a single peak resolution in FTMS. Here Hann window apodization of transient signal was performed. The importance of high sampling frequency of data acquisition system for accurate phase coherence point determination is evident from comparison of top (high sampling frequency) and bottom (standard sampling frequency) panels.

FIG. 23 shows the results of the application of the method of double phase correction described here to a single peak resolution in FTMS. Here apodization of transient signal was not performed. The importance of high sampling frequency of data acquisition system for accurate phase coherence point determination is evident from comparison of top (high sampling frequency) and bottom (standard sampling frequency) panels.

Figure 24:
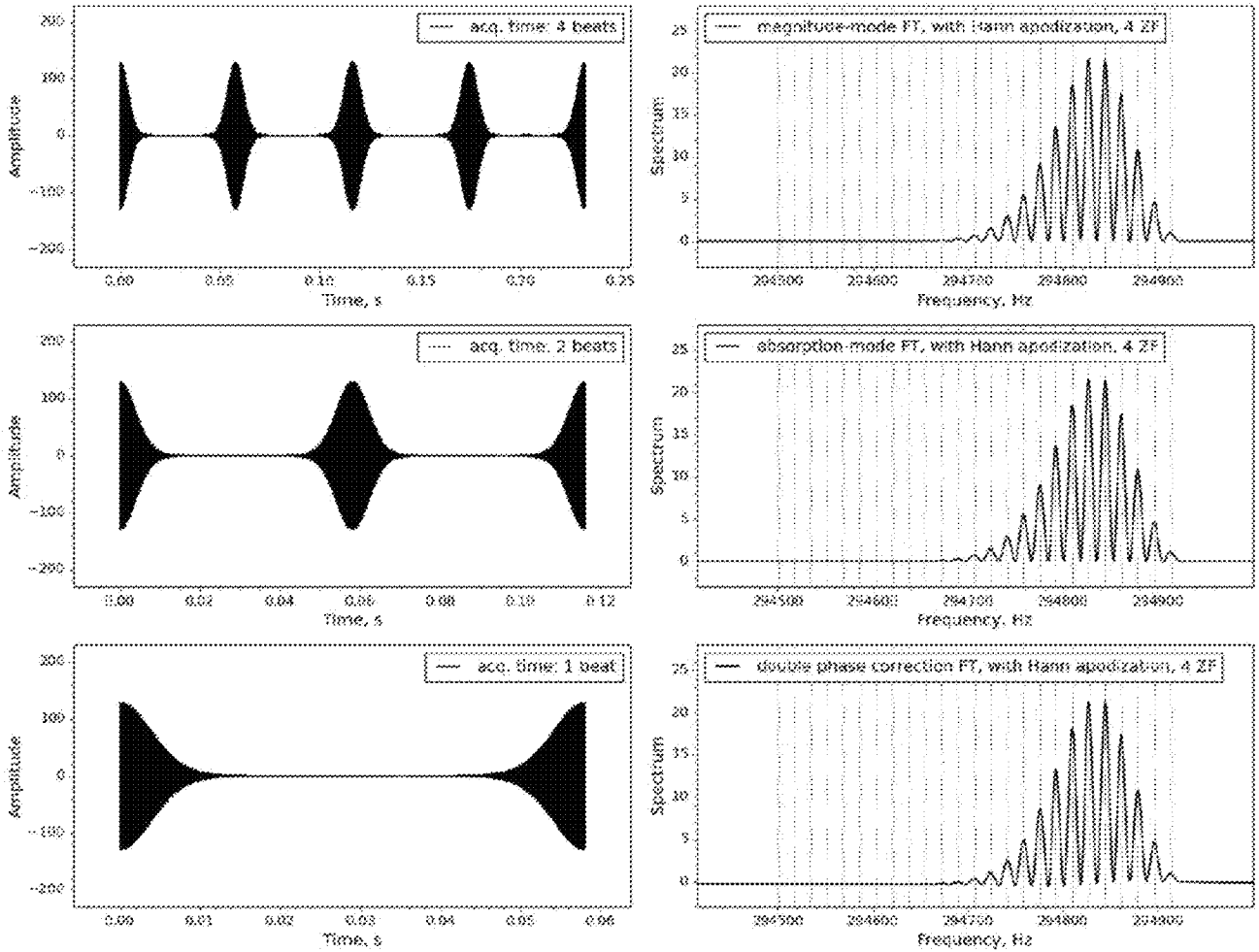
FIG. 24 shows the benefit of the described here method of double phase correction compared to the current state-of-the-art in FTMS.

FIG. 24 shows the benefit of the described here method of double phase correction compared to the current state-of-the-art in FTMS. Baseline resolution and required detection period in the simulated MS analysis of a protein: magnitude-mode FT (top panels), absorption-mode FT (middle panels), and double phase correction FT (bottom panels). The Hann-type apodization windows were used. Four zero-fillings were performed for improved visualization. For convenience, all transients were plotted approximately from their points of phase intersection. Normalization of the spectra for the number of points in the transient signals was additionally made.

FIG. 25 shows application of the double phase correction method in FTMS, compared with magnitude mode FT and absorption mode FT. The analyzed species are a 6.32 mDa doublet of reporter ions in the LC-MS analysis of 10-plex tandem mass tag labeled yeast digest. Top panels: the transient time is such that the peaks are baseline resolved in absorption mode FT and with the double phase correction method. Bottom panes: for a shortened transient, the advantage of resolution performance of the double phase correction FT method over the magnitude and absorption FT modes is illustrated.

DETAILED DESCRIPTION OF THE SPECIFIC PREFERRED EMBODIMENT

Consider ions trapped in a Fourier transform mass analyzer. Provided that the phase coherence of ion packets corresponding to different m/z values is sufficiently high during the data acquisition so that the difference of total phases accumulated by ion packets corresponding to two close m/z values of interest is greater than the developed phase spread of those ion packets, it is the uncertainty principle of the signal processing employed that governs the resolution performance of the mass spectrometer.

Here our consideration is limited specifically to Fourier transform (FT)-based signal processing methods. We derive the relations between how the phases of ions are taken into account in a particular FT-based signal processing method and the corresponding uncertainty principle for measurements of ion frequencies. Specifically, we compare the uncertainty principle for situations when the phase information is not taken into account at all (magnitude mode FT), a single phase intersection point of analyzed ions is employed (absorption mode FT), and when the case of equidistant phase intersection points takes place (selected frequency windows with regularly distributed analytes in a broadband mass spectrum).

Based on the latter, we propose a method of double phase correction, which, for a selected frequency window, provides a two-fold gain in resolution performance compared to the absorption-mode FT in the case of regular m/z distributions of chemical species (including doublets as a particular case). Areas of application for this method include the MS analysis of chemical species for which the difference in their m/z is known or can be roughly estimated. Specifically, the method can be advantageous in quantitative proteomics, e.g., TMT tags experiments, where the m/z difference is always known. It is also applicable in MS analysis of proteins and their fragments (i) when the isotopic peaks are only barely resolved so that the MS deconvolution methods fail to determine the monoisotopic mass of interest or (ii) when the isotopic peaks are not resolved at all but different charge states are available to estimate the m/z difference with the use of the mass calibration equation.

PARTICULARLY FAVORABLE EMBODIMENTS

The present invention has several particularly favorable embodiments, including the following:

18. The suggested method for data analysis in electrostatic ion trap-based FTMS allows increasing resolving power up to twice for the same ion detection period (transient length) compared to the current state-of-the-art including absorption mode FT spectral representation
19. The suggested method for data analysis allows improvement of a baseline correction in double and single phase correction application owing to a properly estimated apodization function directly applied to a transient signal The work leading to this invention has received funding from the European Research Council under the European Union's Seventh Framework Programme (FP7/2007-2013)/ERC grant agreement n° 280271.

The invention claimed is:

1. A device for measuring mass over charge (m/z) ratios of ions in an ion trap of an ion cyclotron resonance (ICR) mass spectrometer, comprising:

excitation electrodes arranged as segments of a cylinder, an interior of the segments of the cylinder forming an ion trap for exciting motion of ions inside the ion trap; and flat narrow aperture detection electrodes that extend in a radial direction and along the axial direction of the cylinder for detecting an integral time-domain signal which comprises individual time-domain signals induced on the detection electrodes by the individual ions in the ion trap, wherein the flat narrow aperture detection electrodes are configured to create a trapping electric potential within an effective volume inside of the ion trap where the ions undergo a motion after ion excitation.

2. The device of claim 1, wherein the trapping electric potential is a non-quadratic function of x, y, and z coordinates.

3. The device of claim 2, wherein the non-quadratic function is such that (i) a Fourier spectrum of an individual time-domain signal, after its averaging over a total ensemble of ions with a given m/z moving in the ion trap after ion excitation, includes a harmonic component at a frequency $\omega$ having a value that is closer to a value of the cyclotron frequency of these ions, $\omega_c$, compared to a value of the reduced cyclotron frequency $\omega_+$ of these ions, and (ii) a spectral magnitude at the frequency $\omega_+$, in this Fourier spectrum is greater than a spectral magnitude at the frequency $\omega_+$ in this Fourier spectrum.

4. The device of claim 1, wherein the flat narrow aperture detection electrodes are shaped according to any one of the list comprising curved, perpendicular, and oval forms.

5. The device of claim 1, wherein a thickness of the flat narrow aperture detection electrodes is between 1 nm and 10 mm.

6. The device of claim 1, wherein an arc length of the flat narrow aperture detection electrodes is between 1 nm and 10 cm.

7. The device of claim 1, wherein the flat narrow aperture detection electrodes are positioned radially inward of the ion trap of the ICR mass spectrometer.

8. The device of claim 1, wherein at least some of the flat narrow aperture detection electrodes are positioned on an equipotential plane of an ion excitation field, with a surface of the at least some flat narrow aperture detection electrodes being normal to unperturbed excitation field lines.

9. The device of claim 1, wherein the excitation electrodes include four wide aperture excitation electrodes, wherein the flat narrow aperture detection electrodes include four narrow aperture detection electrodes that are symmetrically or non-symmetrically distributed, and wherein the four wide aperture excitation electrodes are configured for dipolar, quadrupolar or quadrature ion excitation.

10. The device of claim 1, wherein the excitation electrodes include four wide aperture excitation electrodes, wherein the flat narrow aperture detection electrodes include four narrow aperture detection electrodes that are symmetrically or non-symmetrically distributed, and wherein the four narrow aperture detection electrodes are configured for dipolar, quadrupolar or quadrature ion detection.

11. The device of claim 1, wherein the excitation electrodes include four wide aperture excitation electrodes, wherein the flat narrow aperture detection electrodes include four narrow aperture detection electrodes that are symmetrically or non-symmetrically distributed, and wherein the four wide aperture excitation electrodes are configured to be used for excitation and the four narrow aperture detection electrodes are configured to be used for detection, to realize both quadrupolar or quadrature ion detection and dipolar, quadrupolar or quadrature ion excitation.

12. The device of claim 1, wherein the excitation electrodes include eight wide aperture excitation electrodes, wherein the flat narrow aperture detection electrodes include eight narrow aperture detection electrodes that are symmetrically or non-symmetrically distributed, and wherein the eight narrow aperture electrodes are configured for ion detection by means of realizing (i) two quadrupolar (or quadrature) ion detection schemes, or (ii) four dipolar ion detection schemes, or (iii) two dipolar ion detection schemes with one quadrupolar or with one quadrature ion detection scheme.

13. The device of claim 1, wherein at least one of the flat narrow aperture detection electrodes is: (i) coated by a resistive material, or (ii) shielded by conducting electrodes under a potential, or (iii) grounded, to generate a broadband time-domain signal (transient).

14. The device of claim 1, wherein a dimension of the ion trap of the ICR mass spectrometer having the flat narrow aperture detection electrodes is in a range between 10 mm to 10 cm.

15. A method for measuring mass over charge (m/z) ratios of ions with a measurement device in an ion trap of an ion cyclotron resonance (ICR) mass spectrometer, the measurement device including excitation electrodes arranged as segments of a cylinder, an interior of the segments of the cylinder forming the ion trap, and flat narrow aperture detection electrodes that extend in a radial direction and along the axial direction of the cylinder, the method comprising the steps of:

exciting with the excitation electrodes motion of ions trapped in the ion trap with such measurement device; and detecting with the flat narrow aperture detection electrodes a signal induced by the moving ions.

16. The method of claim 15, wherein the measurement device further includes four wide aperture excitation electrodes, and the flat narrow aperture detection electrodes include four narrow aperture detection electrodes that are symmetrically or non-symmetrically distributed, the step of exciting further comprising: performing quadrupolar or quadrature ion excitation.

17. The method of claim 15, wherein the flat narrow aperture detection electrodes of the measurement device are positioned on an equipotential plane of an ion excitation field, with a surface of the detection electrodes being normal to unperturbed excitation field lines.

18. The method of claim 15, wherein the measurement device further includes eight wide aperture excitation electrodes, and the flat narrow aperture detection electrodes include eight narrow aperture detection electrodes that are symmetrically or non-symmetrically distributed, the step of detecting further comprising: (i) two quadrupolar (or quadrature) ion detection schemes, or (ii) four dipolar ion detection schemes, or (iii) two dipolar ion detection schemes with one quadrupolar or with one quadrature ion detection scheme.

19. The method of claim 15, further comprising exciting ions to a sufficiently large orbit to generate periodic non-sinusoidal time-domain signals (transients).

20. The method of claim 15, further comprising applying the extended Fourier transform basis signal processing described herein to process thus generated time-domain signals (transients) from ions in order to remove unwanted harmonics or increase the resolution.

21. The method of claim 20, further comprising applying the extended Fourier transform basis signal processing described herein to broadband periodic non-sinusoidal time-domain signals (transients) acquired with other devices.

22. The method of claim 15, further comprising applying the double phase correction algorithm described herein for transient signal processing to improve the resolving power.

23. The device of claim 1, wherein the flat narrow aperture detection electrodes are arranged inside a volume formed by the cylinder.

24. The device of claim 1, wherein the excitation electrodes include an electrode pair having two cylindrical segments, each segment being arranged axially-symmetrical to each other.

25. The device of claim 1, wherein the excitation electrodes include two electrode pairs each having two cylindrical segments, each segment of an electrode pair being arranged axially-symmetrical to each other.

26. The device of claim 1, wherein the excitation electrodes include four electrode pairs each having two cylindrical segments, each segment of an electrode pair being arranged axially-symmetrical to each other.

27. The device of claim 1, wherein inner edges of the flat narrow aperture detection electrodes do not reach into an volume delineated by a cylinder having at least 0.4 times the radius of the cylinder formed by the excitation electrodes.

28. The device of claim 1, wherein the flat narrow aperture detection electrodes are positioned on an equipotential plane of an ion excitation field, with a surface of the detection electrodes being normal to unperturbed excitation field lines.

29. The device of claim 1, wherein the excitation electrodes are used to excite the ions to a sufficiently large orbit to generate periodic non-sinusoidal time-domain signals as the individual time-domain signals.

30. The device of claim 1, further comprising a processor for applying an extended Fourier transform basis signal processing to process the individual time-domain signals from the ions to remove unwanted harmonics and/or increase the resolution.

* * * * *